US011162326B2

(12) United States Patent
Duthie

(10) Patent No.: US 11,162,326 B2
(45) Date of Patent: Nov. 2, 2021

(54) ACTUATOR ASSEMBLY

(71) Applicant: Weatherford Technology Holdings, LLC, Houston, TX (US)

(72) Inventor: Jason Duthie, Blackburn (GB)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 16/610,432

(22) PCT Filed: May 1, 2018

(86) PCT No.: PCT/GB2018/051164
§ 371 (c)(1),
(2) Date: Nov. 1, 2019

(87) PCT Pub. No.: WO2018/203047
PCT Pub. Date: Nov. 8, 2018

(65) Prior Publication Data

US 2020/0056450 A1 Feb. 20, 2020

(30) Foreign Application Priority Data

May 2, 2017 (GB) ..... 1706941

(51) Int. Cl.
*E21B 34/14* (2006.01)
*E21B 34/10* (2006.01)

(52) U.S. Cl.
CPC ..... *E21B 34/14* (2013.01); *E21B 34/10* (2013.01); *E21B 2200/06* (2020.05)

(58) Field of Classification Search
CPC ..... E21B 34/14; E21B 34/10; E21B 2200/06; E21B 23/004; E21B 34/12; E21B 21/10; E21B 21/103
See application file for complete search history.

(56) References Cited

U.S. PATENT DOCUMENTS 2,610,846 A 9/1952 Hanna
3,174,500 A * 3/1965 Johnson ..... C01G 43/06 137/119.09

(Continued)

FOREIGN PATENT DOCUMENTS

CN 202081863 U 12/2011
GB 2194298 A 3/1988

(Continued)

OTHER PUBLICATIONS

International Search Report and the Written Opinion for International Application No. PCT/GB2018/051164 dated Aug. 22, 2018, 1 pages.

(Continued)

*Primary Examiner* — D. Andrews
*Assistant Examiner* — Jonathan Malikasim
(74) *Attorney, Agent, or Firm* — Patterson + Sheridan, LLP

(57) ABSTRACT

An oil or gas well actuator (1) assembly comprising a fixed member (10), an actuating member (30) being moveable axially with respect to the fixed member, with open-ended recesses containing canted coil springs (40) on e.g. the fixed member and a radially extending shoulder (30*s*) on the actuating member which adapted to engage a canted coil spring within a recess (20). A support member (50) is adapted to cover open ends of the recesses and moves into different axial positions with respect to the recesses to uncover open ends of different recesses in the different axial positions of the support member. Expansion of a canted coil spring (40) from an open end of a recess engages with the shoulder (30*s*) to restrict movement of the actuating member (30) at indexed positions. When the actuating member (30) moves relative to the support member direction, the support (Continued)

member (50) retains its position relative to the canted coil spring.

26 Claims, 22 Drawing Sheets

(56) References Cited

U.S. PATENT DOCUMENTS

| | | | | |
|---|---|---|---|---|
| 4,655,462 | A | 4/1987 | Balsells | |
| 4,678,210 | A | 7/1987 | Balsells | |
| 4,826,144 | A | 5/1989 | Balsells | |
| 4,876,781 | A | 10/1989 | Balsells | |
| 4,964,204 | A | 10/1990 | Balsells | |
| 5,411,348 | A | 5/1995 | Balsells | |
| 5,545,842 | A | 8/1996 | Balsells | |
| 6,672,565 | B2 * | 1/2004 | Russell | E21B 21/106 251/297 |
| 7,175,441 | B2 | 2/2007 | Naviaux et al. | |
| 7,722,415 | B2 | 5/2010 | Chansrivong | |
| 8,308,167 | B2 * | 11/2012 | Balsells | A61B 17/162 279/23.1 |
| 9,004,805 | B2 | 4/2015 | Changsrivong et al. | |
| 9,312,630 | B2 | 4/2016 | Huang | |
| 2010/0029145 | A1 | 2/2010 | Balsells et al. | |
| 2010/0126711 | A1 | 5/2010 | Buss et al. | |
| 2013/0149029 | A1 | 6/2013 | Changsrivong et al. | |
| 2013/0149031 | A1 | 6/2013 | Changsrivong et al. | |
| 2014/0069652 | A1 | 3/2014 | Gay et al. | |

FOREIGN PATENT DOCUMENTS

| | | | |
|---|---|---|---|
| JP | H06137353 | A | 5/1994 |
| JP | H11153166 | A | 6/1999 |
| JP | 2001304336 | A | 10/2001 |
| RU | 2147665 | C1 | 4/2000 |
| RU | 2568615 | C1 | 11/2015 |
| RU | 2015144048 | A | 4/2017 |
| WO | 2009126968 | A1 | 10/2009 |
| WO | 2010129293 | A2 | 11/2010 |

OTHER PUBLICATIONS

EP Search Report under Section 17 for EP Application No. GB1706941.0 dated May 17, 2017, 2 pages.

LQR® Lock and Quick Release System—Featuring Bal Spring Published Mar. 29, 2017, Accessed May 16, 2017, Available from <https://www.youtube.com/watch?v=YuHwqRRyQec> BAL SEAL; Whole Video.

Oil and Gas Industry Solutions, Published Jul. 2, 2009, Accessed May 16, 2017, Available from https://www.youtube.com/watch?v=JuRzKrXVjso <https://protect-us.mimecast.com/s/GeaPCKr7k2I2E23IvLLm1?domain=youtube.com> BAL SEAL; Whole Video.

Russian Office Action dated Aug. 17, 2021, for Russian Patent Application No. 2019132630/03(064134).

* cited by examiner

ACTUATOR ASSEMBLY

The present invention relates to an actuator assembly, and to a method of its use. In some examples, the actuator assembly provides an indexing mechanism configured to adopt a number of separate and different indexed positions. In some examples, the actuator assembly is a downhole actuator assembly, and is adapted to be incorporated within a downhole assembly for actuating a tool in an oil, gas or water well.

Downhole tools frequently need to switch between different configurations in the well, corresponding to different states of actuation to control operations in the well. For example, sliding sleeve valves frequently need to adopt open or closed configurations, or different intermediate positions between 100% open and 100% closed, in order to control the flow of fluid through an aperture.

SUMMARY

The present invention provides an oil or gas well actuator assembly comprising: a fixed member having an axis;

an actuating member being moveable axially with respect to the fixed member;

a plurality of open-ended recesses on one of the fixed member and the actuating member wherein each recess at least partially houses a canted coil spring;

a radially extending shoulder on the other of the actuating member and the fixed member adapted to engage a canted coil spring within a recess;

a support member adapted to cover open ends of the recesses and being moveable axially into different axial positions with respect to the recesses to uncover open ends of different recesses in the different axial positions of the support member.

Expansion of a canted coil spring from an open end of a recess optionally engages with the shoulder to restrict movement of the actuating member at indexed positions. Movement of the actuating member causes the shoulder to move relative to the springs in the recesses, and causes the shoulder to engage a spring. Engagement of the shoulder with a spring in a first configuration in the recess can resist movement of the shoulder past the spring. Engagement of the shoulder with a spring in a second configuration can allow movement of the shoulder past the spring. Movement of the actuating member can flip the springs between the first and second configurations.

Covering the open end of a recess optionally resists changes in configuration of the canted coil spring within the recess. Optionally covering the open end maintains compression of the spring in the recess which resists changes in the orientation of the spring within the recess, keeping it in the same orientation while the open end of the recess is covered. Uncovering of the open end of the recess optionally permits changes in configuration and/or orientation of the canted coil spring within the recess. In certain examples, the recess open ends can be covered by the support member or by the actuating member. Covering the open end of a recess optionally maintains a minimum level of compression of the spring within the recess, and uncovering the open end of a recess optionally permits expansion of the spring from the recess.

The change of configuration of the spring in the recess when the open end is uncovered optionally occurs in response to movement of the actuating member or the support member in relation to the open end, optionally movement across the open end. Optionally each canted coil spring is resiliently energised in compression within the recess. One end of the energised canted coil spring is biased resiliently out of the recess, and at least a part of the canted coil spring protrudes out of the recess to engage the shoulder and stop the movement of the actuating member when the shoulder and the spring engage, optionally in an indexed position. Optionally the actuating assembly has multiple indexed positions, optionally equal to the number of recesses, at which the axial movement of the actuating member is brought to a stop in sequential indexed positions between a starting position of the actuator member and a final position of the actuating member corresponding to a functional change, for example, the opening of a valve, triggering of a tool etc.

In different positions of the support member in some examples, the open ends of some recesses are uncovered, and the open ends of other recesses are covered.

Optionally the support member, the fixed member and the actuating member are concentric.

Optionally each recess is symmetrical around a radius of the axis of the fixed member (the radius extending perpendicular to the axis of the fixed member).

Optionally, each recess has first and second axially spaced sidewalls on either axial side of the open end. Optionally the sidewalls are mutually parallel and are also parallel to the radius. Optionally each recess has a square profile with a bottom wall disposed axially between the sidewalls at the inner end of the recess.

Optionally, each canted coil spring is energised, e.g. compressed when the open (outer) end of the recess containing the canted coil spring is covered, optionally by the support member or the actuating member. Optionally, each coil in each spring naturally adopts an elliptical configuration having a major axis and a minor axis. Each coil of each spring is optionally canted with respect to the centreline of the spring.

In cross section through its centreline, each canted coil spring optionally has an elliptical configuration having a major axis and a minor axis. Optionally the movement of the shoulder past the spring in the recess is resisted when the spring is compressed by the shoulder into the recess along its major axis.

Optionally when energised e.g. in compression within the recess, with the open end of the recess covered, each canted coil spring adopts an elliptical configuration with the major axis of each spring being canted across the long axis of the bore (i.e. non-parallel with the axis of the fixed member) when the recess is covered, and when energised, the configuration of the spring in the recess is optionally non-symmetrical with respect to a radius perpendicular to the axis. Optionally each spring can adopt an energised elliptical configuration with the major axis canted across a radius of the axis. In other words, two different alternative energised (e.g. compressed) elliptical configurations of each spring are possible in each recess, with the major axis of the canted springs being canted either in one direction (i.e. /) or in the opposite direction (i.e. \) across the radius of the axis. Optionally, when in the canted (optionally compressed) configuration in the recess, the major axis of the spring is parallel to or aligned with a diagonal of the recess, between opposite corners of the recess, and the minor axis of the spring is parallel to (but not necessarily aligned with) the opposite diagonal of the recess. Optionally in the two alternative compressed configurations of each spring, the major axis is parallel to or aligned with different diagonals of the recess.

Optionally when the spring is in a resting or neutral configuration (i.e. not in compression) it naturally adopts an elliptical shape within the recess, and is optionally symmetrical around a radius. Optionally in the neutral configuration, the length of the spring along the major axis is greater than the distance along a diagonal of the recess, i.e. between diagonally opposite corners of the recess, so that in the resting and uncompressed configuration, the spring does not fit completely within the recess, and one end of the major axis of the spring will normally protrude from the open end of the recess. In such examples, in order to fit within the recess, the spring is optionally resiliently compressed into the recess, e.g. when the open end is covered, which stores energy in the spring, and this optionally forces the spring to adopt a canted compressed configuration in the recess, with the major axis of the spring aligned with the diagonal. Thus the spring can optionally resiliently expand through the open end of the recess, for example, once the compressive force acting on it has been removed, e.g. when the open end of the recess is uncovered.

In some examples, the spring is more resilient and allows greater flex along its minor axis than along its major axis.

The springs optionally have an inner end (further inside the recess, and normally engaged against the inner end of the recess) and an outer end (closer to the open end of the recess than the inner end of the spring). Optionally the outer ends of the springs are urged towards and optionally out of the open ends of the recesses by the resilience of the spring when the spring is energised (i.e. when the open end of the recess is covered).

Optionally in a first canted configuration of the springs, the outer end of each spring faces axially toward the shoulder; in other words, the outer end of the spring at the open end of the recess is axially closer to the shoulder than the inner end of the spring at the inner end of the recess, when the distance between the shoulder and spring is reducing. Hence as the shoulder approaches a recess (or vice versa) containing a spring in the first canted configuration, the outer end of the spring is axially spaced closer to the shoulder than the opposite inner end of the spring. The inner end of the spring is disposed in the recess, while the outer end of the spring is adjacent to the open end of the recess or protruding from the recess through the open end. Optionally, once the shoulder reaches the recess containing the spring in the first canted configuration, the shoulder initially engages the outer end of the spring resiliently biased out of the recess. Since the spring is relatively resistant to further compression along its major axis, the engagement of the shoulder with the facing outer end of the spring in the first configuration can be used to resist axial movement of the shoulder in a first direction (e.g. in an actuating direction of the member bearing the shoulder). In the first canted configuration, the inner end of the major axis of the spring is optionally disposed in an inner corner of the recess, optionally between the bottom wall and the sidewall ahead of the shoulder, and the outer end of the major axis of the spring is optionally protruding from the recess in front of the shoulder which is moving towards it in a first direction towards a final actuation position. Of course, it is not essential that the shoulder moves and the recess remains still. In some examples, the shoulder can be static and the recesses can be provided on the actuating member; thus references here to the shoulder moving relative to the recess or the spring are understood to be applicable also to examples where the shoulder is static in relation to the fixed member and the recess and spring move relative to the shoulder, and vice versa.

As the shoulder and recess draw closer while the actuating member is moving in the first direction, the shoulder engages with the outer end of the major axis of the spring that is protruding from the recess in front of the shoulder. Thus, optionally, in the first configuration the major axis of the spring is pointing generally towards the shoulder, and the minor axis of the spring is pointing generally away from the shoulder, optionally in an axial direction. The spring is relatively resistant to deformation along the major axis, which is generally parallel with the diagonal of the recess in the first canted configuration, so when the shoulder engages the outer end of the major axis of the spring pushing out of the recess, the spring does not substantially compress much further into the recess and resists further movement of the shoulder (and hence the member carrying it) in the first direction (e.g. towards the actuation position). Since the inner end of the spring is trapped in the recess ahead of the shoulder, e.g. in the corner, the spring remains in the first canted configuration and cannot easily move in the recess or shift within the recess to permit greater deformation in a different configuration. The high resistance to deformation along the major axis of the spring trapped in the recess therefore prevents or restricts movement of the shoulder in the first direction past the point when the shoulder engages the outer end of the spring. At this point the actuating member can withdraw in the opposite second direction in the bore, but cannot move forward such that the shoulder moves past the groove without disrupting the spring within the groove beyond its limits of plastic deformation.

Optionally an alternative second energised canted configuration of the spring permits axial movement of the actuating member past the spring, e.g. in the same first direction. The first and second configurations are similar, except that the spring is generally parallel to opposite diagonals in the recess. Thus, while in the first configuration, the spring is generally parallel with or aligned with one diagonal, in the second configuration, the spring is generally parallel with or aligned with the other diagonal of the recess. Thus in the second configuration, while the inner end of the major axis of the spring is still disposed in the recess, it is axially closer to the shoulder than the outer end, and while the outer end of the major axis of the spring is still protruding from the recess it is axially further away from the shoulder than the inner end. Thus, optionally, in the second configuration the major axis of the spring is pointing away from the shoulder, and the minor axis of the spring is generally pointing towards the shoulder. Since the minor axis of the spring is more compressible than the major axis, the forwards movement of the shoulder against a rear face of the outer end of the spring compresses the spring into the recess by applying force along the more deformable minor axis, deforming the spring further into the recess along its minor axis, and permitting passage of the shoulder past the recessed and compressed spring.

Optionally in a resting or neutral configuration of the spring, when the major axis of the spring is not substantially canted across the axis of the bore and the spring is expanded partially into the bore and out of the recess, optionally in a generally symmetrical configuration around a radius of the bore, the spring can be moved, e.g. rotated, in the recess between the two different energised canted configurations by the movement of the actuating member (or the support member) axially within the bore in each direction. Optionally the spring transitions through the neutral position when moving between the two alternative compressed and canted configurations.

Optionally, the recesses are provided on the inner surface of the fixed member. Optionally, the recesses are provided on an inner surface of a housing sleeve, which is received within the fixed member, which may comprise a housing. Optionally, the inner surface of the housing sleeve forms at least a part of the bore within the housing which receives the actuating member. In other words, the actuating member can be received within the bore of the housing sleeve, and can move axially therein between the separate positions of the actuating member.

Optionally the springs permit movement of the shoulder past the recesses and springs in a second direction in either of the first and second configurations. In other words, the shoulder and spring optionally forms a unidirectional stop, stopping movement of the actuating member in only one direction (the first direction) when the spring is in the first configuration.

Optionally, the housing sleeve also receives the support member, which is moveable within the bore of the housing sleeve between separate positions in response to movement of the actuating member. The provision of the recesses on the inner surface of the housing sleeve is useful for construction and assembly of the actuator assembly, and allows different sizes of bore, and different sizes of canted coil springs, to be used with one housing, but it is of course possible to form the recesses on the inner surface of the housing without necessarily employing a sleeve.

Optionally, the support member comprises a sleeve, having a bore with an axis that is optionally coaxial with the axis of the housing. The support member optionally permits fluid communication axially from one side of the support member to the other, optionally through the bore. Optionally, the actuating member can be moved between different positions in response to changes in fluid pressure differential across the actuating member, which may be transmitted through the support member (optionally through the bore or some other fluid conduit).

Optionally, the actuating member can comprise a piston, which may be sealed within a bore of the housing, optionally at a location spaced from the recesses. Optionally the piston has more than one seal, dividing portions of the bore into different zones between the seals. Optionally, the different axial positions adopted by the actuating member within the bore trigger different configurations of a tool connected to the actuator assembly and under its control. Optionally the separate positions of the actuating member correspond to separate states of actuation of the downhole tool.

For example, in one example, the actuating member can itself comprise a part of the tool, for example a component of a sliding sleeve valve system, which slides axially within the housing in order to move respective apertures in the actuating member and the fixed member in and out of alignment, and optionally to vary the extent of overlap of such apertures in order to control the cross-sectional area of a fluid conduit allowing radial movement of the fluid through the walls of the actuating member and the fixed member. Optionally the different axial positions can represent intermediate indexing positions that do not trigger individual changes in function of a tool, for example, the opening of a valve or the like, but which individually advance the tool towards a configurational change. Thus, sequential changes in differential pressure applied to the assembly can move the assembly through transitional intermediate positions before a final actuating step.

Optionally the recesses are provided on the actuating member. Optionally the support member comprises a sleeve that receives the actuating member. Optionally the support member moves over the surface of the actuating member. Optionally the movement of the support member over the actuating member is limited by the fixed member.

At least two canted coil springs each in a respective recess are optionally provided, but the number of springs and recesses can be varied in different examples.

Optionally, the actuating member can be biased axially in one direction by a resilient biasing device, such as a spring, for example a coiled spring, which can optionally be held in compression. Movement of the actuating member between separate positions relative to the fixed member can optionally be triggered by controlling a fluid pressure differential opposing the force of the biasing device. For example, the biasing device may be biasing the actuating member axially in one direction, and a fluid pressure differential may be biasing the actuating member in the opposite direction in order to resist movement of the actuating member by balancing out the force applied by the biasing device. Reduction of fluid pressure on one side of the actuating member can result in movement of the actuating member under the force applied by the biasing device, which overcomes the lower pressure differential in order to move the actuating member axially. Increasing the fluid pressure on the actuating member can overcome the force of the spring and move the actuating member in the opposite direction, compressing the spring.

Optionally the support member moves relative to the spring in response to the movement of the actuating member. Optionally, the actuating member pushes the support member between its separate positions. Optionally, the support member is held static relative to the fixed member as the actuating member moves relative to the support member, resulting in movement of the support member relative to the spring. Optionally the actuating member is pulled through the support member. Optionally the support member moves in only one direction relative to the spring. Optionally when the actuating member moves relative to the support member in one direction, the support member retains its position relative to the spring. Optionally when the actuating member moves relative to the support member in the other direction, the support member moves relative to the spring.

Optionally, axial movement of the actuating member in a first direction moves the support member in the same first direction, so that the support member moves with the actuating member in the first direction. However, in certain examples, the support member optionally moves with the actuating member only in the first direction, and when the actuating member moves in a second direction, opposite to the first direction, the actuating member and support member optionally separate, with the support member optionally remaining static, and retaining its position, while the actuating member moves axially away from the support member in the second direction.

Optionally, the support member can be centralised within the assembly, for example by a centralising section of the support member being received within or by a portion of the assembly (e.g. a bore) with close tolerance and with parallel sides. Optionally, the centralising section of the support member is disposed at one end of the support member, and does not typically engage or support any of the springs housed in the recesses. Optionally the centralising section of the support member has a wider diameter than a spring support section of the support member that is spaced axially away from the centralising section of the support member along its axis. Optionally the springs expand radially from the recesses and engage the spring support section through the open ends of the recesses. Optionally, the spring support section of the supporting member engages the springs and supports them within the recesses, maintaining their compressed configuration within the recess.

Optionally, the member bearing the shoulder is also adapted to engage the canted coil springs within the recesses, and to support them and optionally energise them within the recesses. Optionally, the member supporting the shoulder has a spring supporting section, optionally on its outer diameter, adapted to support and engage the springs within the recesses.

Optionally the member bearing the shoulder (e.g. the actuating member) is also adapted to be centralised within the assembly, for example by a centralising section of the actuating member being received within a section of bore with close tolerance and with parallel sides. Optionally, the centralising section is disposed at one end of the member, and does not typically engage or support any of the springs housed in the recesses. The centralising section can comprise spaced apart shoulders.

Optionally the member bearing the shoulder has a number of different sections sequentially arranged along its length with different diameters. The centralising section is optionally disposed at one end, and can incorporate a seal between the shoulders. The diameter of the member optionally transitions through a ramp which coincides with a radial expansion space between the fixed member and the actuating member to the shoulder that optionally fits with a close tolerance against the recessed part of the assembly, optionally the internal surface of the housing sleeve. The shoulder optionally extends radially with respect to the axis of the assembly, engaging the recessed part in a tight fit. The shoulder optionally divides the ramp coinciding with the expansion area and a spring support section of the member that is optionally disposed at an end of the member bearing the shoulder. Optionally the spring support section has a different diameter so that its surface is radially separated by a small distance from the recessed part, so that the springs can expand radially out of the recesses across the small radial distance, and engage the spring support section. Optionally, the spring support section of the member bearing the shoulder engages the springs and supports them within the recesses and allows slight limited expansion of the springs out of the boundaries of the recess, yet maintains a small amount of compression on the springs, so that there is optionally clearance between the recessed part and the spring support section of the actuating member.

Moving the member bearing the shoulder across the free ends of the recesses can optionally shift the springs between the first and second canted positions in the recesses, optionally when the member bearing the shoulder is moved across the free ends of the recesses first in one direction and then in the opposite direction. Shifting the springs between different first and second canted positions, optionally from a first position in which the spring engages with the member bearing the shoulder and resists passage of the shoulder past the recess, to a second configuration in which the spring engages with the actuating member and permits passage of the shoulder past the recess holding the spring, can be used to stop the movement of the actuating member in defined positions, for example, as the shoulder reaches a boundary of a recess, and control more precisely the stop locations of the actuating member relative to the fixed member.

Optionally a spring in the second configuration can resist passage of the shoulder in the second direction. Optionally the shoulder has first and second faces, optionally facing in opposite directions. Optionally each of the first and second faces is adapted to engage with a spring in one of the first and second configurations to arrest movement of the actuating member in a first or a second direction. Optionally the first face of the shoulder is adapted to engage with a spring in a first configuration to arrest movement of the actuating member in a first direction. Optionally the second face of the shoulder is adapted to engage with a spring in a second configuration to arrest movement of the actuating member in a second direction.

Optionally the shoulder maintains a second configuration of the spring while the spring is in contact with the shoulder. Optionally the shoulder has a profiled region which engages the spring and maintains it in the second configuration. Optionally the spring maintained in the second configuration by the shoulder resists passage of the shoulder (for example the second face of the shoulder) past the said spring in the second configuration when the shoulder is moving in the second direction.

Optionally the assembly comprises an axial fluid flow path through the housing. This optionally connects a flowpath on a first side of the assembly with a flow path on a second side of the assembly. Thus the assembly can optionally connect in line with a fluid conduit in a tubing string for example. Optionally the assembly can be used for choking of the flow of fluid from fluid flow path to an external surface of the assembly, for example, to an annulus between the assembly and an inner surface of the well. This example is useful for circulating tools for example.

The invention also provides a method of actuating a tool for an oil, gas or water well, the tool having an actuator assembly comprising:

a fixed member having an axis;

an actuating member moveable axially with respect to the fixed member;

a plurality of open-ended recesses on one of the fixed member and the actuating member wherein each recess at least partially houses a canted coil spring;

a radially extending shoulder on the other of the actuating member and the fixed member adapted to engage a canted coil spring within a recess;

a support member adapted to cover open ends of the recesses and being moveable axially into different axial positions with respect to the recesses;

wherein the method includes:

moving the actuating member axially with respect to the fixed member;

moving the support member past at least a part of an open end of a recess housing a canted coil spring; and restricting axial movement of the actuating member by engaging the shoulder with at least a part of the canted coil spring extending from the open end of the recess.

The invention also provides a valve comprising an actuator assembly as defined herein. Certain valves according to the present disclosure can be reset to a closed position from any index position of the sleeve, without necessarily needing to cycle through every indexed position, which can save time when closing the sleeve, which is especially significant in the event of closure to restrict an uncontrolled release of hydrocarbons. Certain valves also permit a confirmed signature that the sleeve is fully closed compared to a cyclic sleeve that relies on the known position of the sleeve by the operator.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention.

Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the scope of the present invention. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. In particular, unless otherwise stated, dimensions and numerical values included herein are presented as examples illustrating one possible aspect of the claimed subject matter, without limiting the disclosure to the particular dimensions or values recited. All numerical values in this disclosure are understood as being modified by "about". All singular forms of elements, or any other components described herein are understood to include plural forms thereof and vice versa.

Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

References to directional and positional descriptions such as upper and lower and directions e.g. "up", "down", "left", right" etc. are to be interpreted by a skilled reader in the context of the examples described to refer to the orientation of features shown in the drawings, and are not to be interpreted as limiting the invention to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

DETAILED DESCRIPTION

Figure 1:
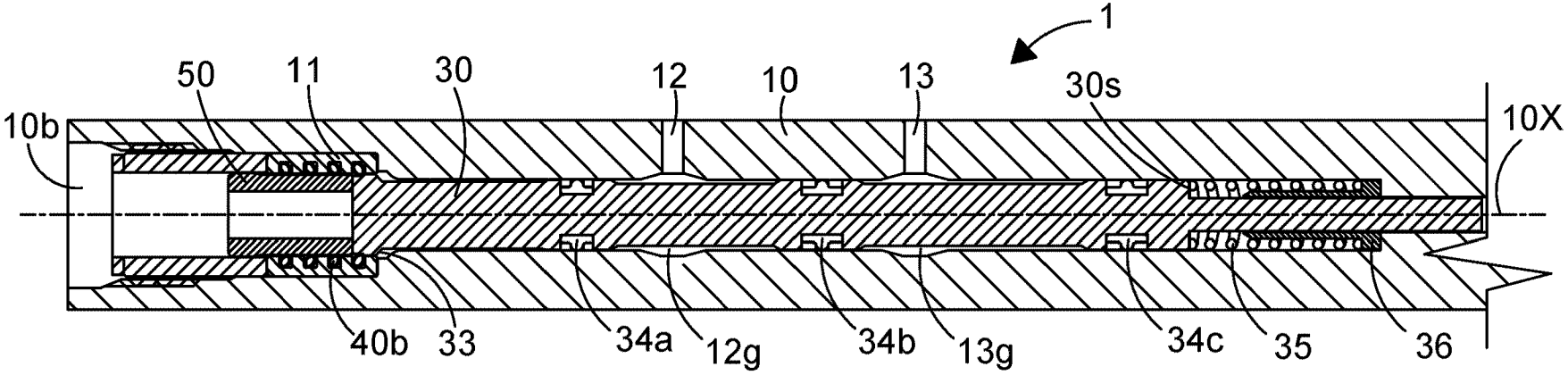
FIG. 1 shows a sectional view through an actuator assembly.

Referring now to the drawings, an actuator assembly in the form of a valve 1 is shown in the figures in cross-section. The valve 1 has a fixed member in the form of a housing 10, with a tubular bore 10*b* which receives an actuating member in this example taking the form of a piston 30 comprising a solid rod which is centralised within the bore 10*b*. The piston 30 is sealed in the bore 10*b* via seals in order to selectively isolate respective sections of the bore. The bore 10*b* has an inner section (shown at the right hand side of FIG. 1 and FIG. 12), having a narrow inner diameter (ID), a central section having a slightly larger ID than the inner section, and an outer section, which is counter-bored with a further step up in ID at the outer end of the valve 1 (shown at the left hand side of FIG. 1 and FIG. 12). The stepwise increases in the ID of the bore between the inner and central sections, and between the central and outer sections of the bore 10*b* take the form of shoulders facing the outer end of the bore 10*b*. In the central section, the piston 30 is sealed to the inner surface of the bore 10*b* via seals 34*a*, 34*b*, 34*c*, which can optionally comprise elastomeric O-ring seals or the like.

The piston 30 has an inner section, a central section, and a head, sequentially arranged along the piston 30 and having different diameters. The inner section of the piston comprises a narrow shaft which is received within the narrow inner section of the bore 10*b*. The narrow shaft of the inner section of the piston 30 is retained by an end cap 36, and a biasing device in the form of a resilient piston drive spring 35 is held in compression between a shoulder 30*s* on the piston 30, and the opposing outer face of the end cap 36. The end cap 36 abuts against an outwardly-facing shoulder in the bore 10*b*, at the step-up between the inner and central sections of the bore. The spring 35 is thus held in compression around the narrow end of the shaft of the piston 30 and biases the piston out of the bore 10*b*, towards the outer section thereof. Axial movement of the piston 30 within the bore is driven by fluid pressure generated by a pump (not shown) outside the bore 10*b* which increases pressure within the bore 10*b* on the outside of the seals 34, to overcome the force of the spring 35 and cause the piston 30 to withdraw into the bore 10*b*, compressing the spring 35 as it does so. The movement of the piston in the reverse direction is controlled by balancing the pressure acting on the seals 34. When the pressure is balanced against the force of the spring 35, the piston remains static. When the force from the fluid pressure is higher than the force of the spring 35, the piston 30 withdraws into the bore 10*b* under the force of the fluid pressure. When the force from the fluid pressure is lower than the force of the spring 35, the piston is driven out of the bore by the spring force.

The seals 34 are retained on shoulders on the piston 30 extending radially outwards towards the inner surface of the bore 10*b*. When the seals 34 are compressed between the two surfaces, this seals the zones between adjacent seals 34. The housing has an inlet 12 and an outlet 13 passing radially from the outer surface of the housing 10 and opening into the inner surface of the bore 10*b* in the central section. At the openings of the inlet 12 and outlet 13 into the bore 10*b*, the inner wall of the bore 10*b* has a respective annular groove 12*g*, 13*g* machined circumferentially around the inner surface of the bore 10*b*, so that in these sections of the bore of the central section, the inner diameter of the bore is wider than in adjacent sections, and so is not constant. In the grooves 12*g*, 13*g*, the inner wall of the bore 10*b* gradually tapers radially outwards at an angle towards the opening of the inlet 12 and outlet 13 into the bore 10*b*.

When the seals 34 carried on the piston 30 are compressed between the inner surface of the bore 10*b* and the outer surface of the piston 30 at positions spaced axially away from the annular grooves 12*g*, 13*g* around the inlet 12 and outlet 13, the seals 34 are radially compressed and resist fluid flow past the seals 34 in the annulus. This isolates the various zones between the seals, and such a configuration is shown in FIG. 1. However, when the piston 30 slides axially within the bore 10*b* to a position where a seal, for example seal 34*b*, moves axially into the annular groove 12*g* around the inlet 12, the seal 34*b* is no longer compressed between the larger diameter inner surface of the bore 10*b* and outer surface of the piston 30, and no longer presents a barrier to fluid flow past the seal. Hence fluid flowing through the inlet 12 can flow past the unloaded seal 34*b* in the annulus in each direction. Thus, axial movement of the piston 30 within the bore 10*b* can open and close fluid communication between the inlet 12 and outlet 13 by moving the seals 34 into and out of the grooves 12*g*, 13*g*. FIG. 1 shows a configuration where the inlet 12 is sealed by seals 34*a* and 34*b* on either side, and the outlet 13 is sealed by seals 34*b* and 34*c* on either side; whereas in the FIG. 12 configuration, seals 34*a* and 34*c* are engaged and resist fluid flow past those seals at the outer and inner sides of the inlet and outlet 12, 13, but seal 34*b* is axially aligned with the groove 12*g*, and is spaced radially from the inner surface of the bore 10*b*, and hence is not compressed against the wall of the bore, and presents no barrier to fluid passage, allowing fluid from the inlet 12 to flow through the opening in the groove 12*g*, and through the annulus between the piston 30 and the inner surface of the bore 10*b*, to the outlet 13 as shown by the arrows in FIG. 12. Notice that the seals 34*a* and 34*c* at opposite ends of the piston 30 still maintain pressure integrity within the central section of the bore 10*b* when the seal 34*b* is unloaded.

Figure 12:
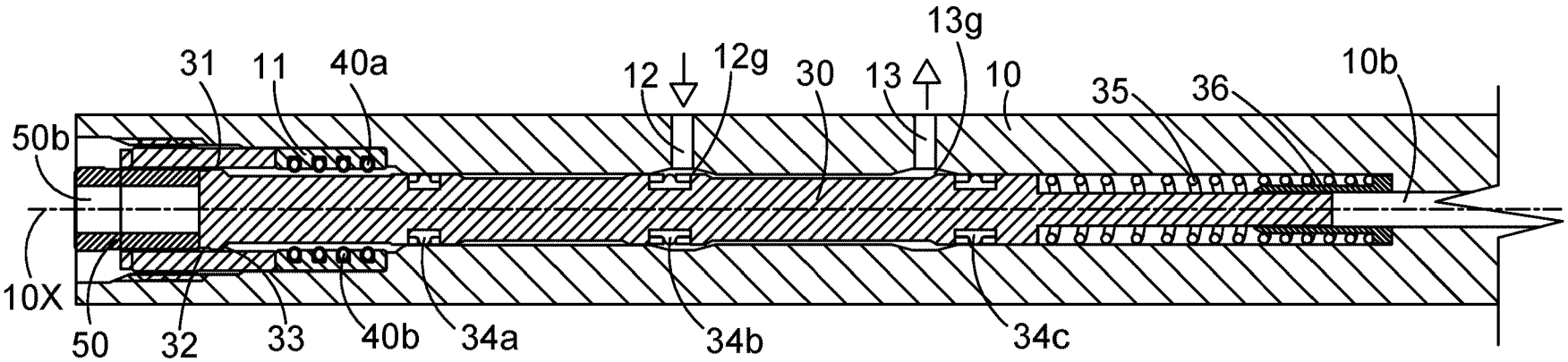
FIG. 12 shows a sectional view through the FIG. 1 actuation assembly in the FIG. 11 position.

As will be described below, this example provides an indexing mechanism to control and to index the movement between the closed configuration of FIG. 1 where the inlet 12 is isolated from the outlet 13, to the open configuration of FIG. 12, where inlet 12 is connected to the outlet 13 allowing fluid flow between the two.

Figure 14:
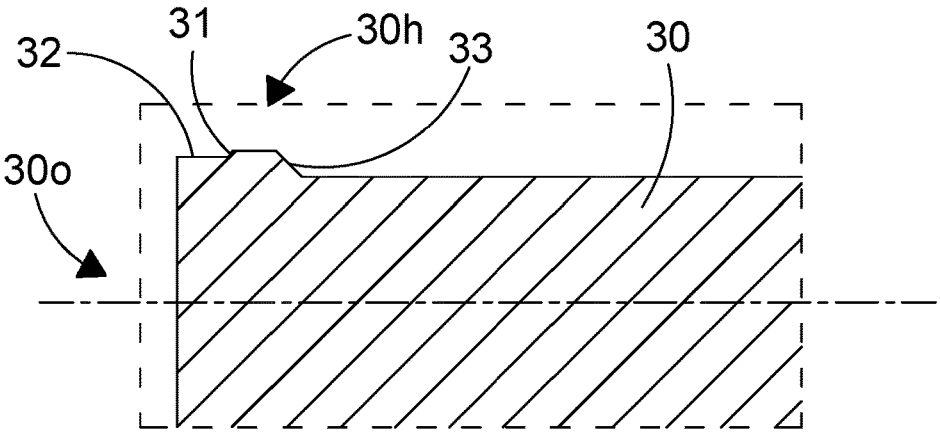
FIG. 14 shows an enlarged sectional view of a head of a piston on the FIG. 1 assembly.

As best shown in FIG. 14, the outer end of the piston 30 has a head 30*h* having a larger outer diameter than the central section of the piston 30. The outer diameter of the piston 30 transitions from the central section to the head via a ramp 33, which is inclined at an angle towards the outer end 300 of the piston 30. The head 30*h* has a plateau section having a relatively consistent outer diameter before tapering radially inwards at a steep angle at shoulder 31 to a cylindrical nose 32, which has a smaller outer diameter, intermediate between the outer plateau of the head 30*h* and the central section of the piston 30. The angle at the outer shoulder 31 between the flat plateau section and the angled front face leading to the nose 32 is steep, and in some examples can be substantially perpendicular to the axis of the piston. In this example, the angled face between the nose 32 and the plateau is at least (in this example) 50-55° with respect to the axis of the piston, and the ramped face 33 on the other side of the plateau section between the plateau section and the central section of the piston is at most (in this example) approximately 45-50°, presenting a shallower angle on the inner face of the plateau than on its outer face for reasons that will be described below. It will be understood that the dimensions and angles can be varied in other examples.

Figure 8:
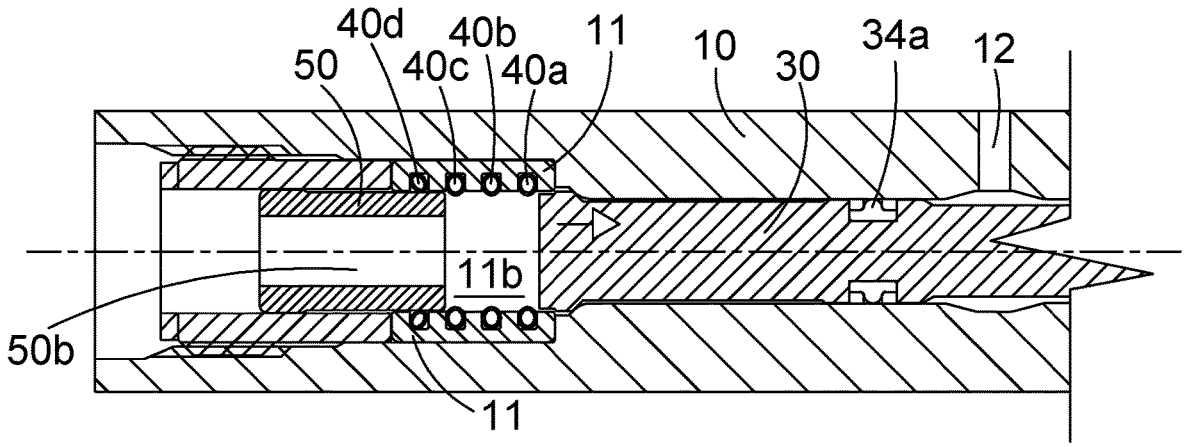
Figure 10:
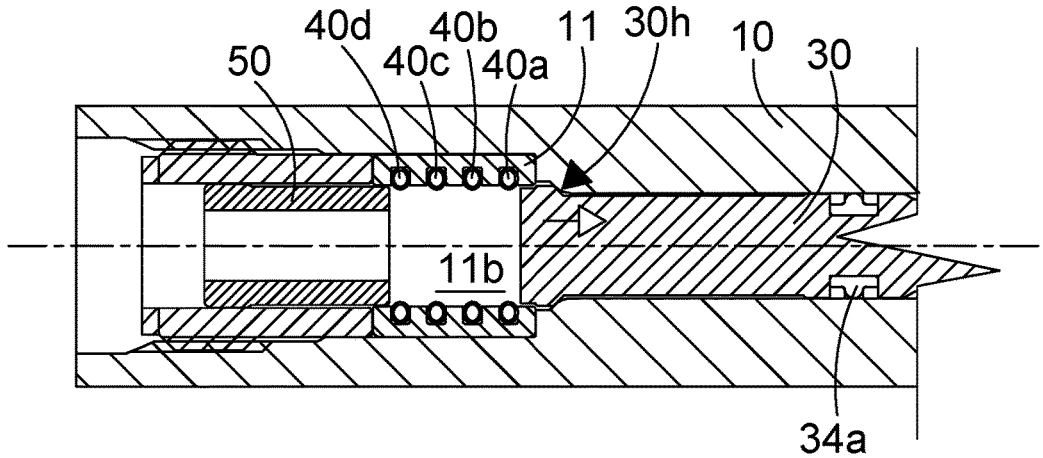

The housing 10 at its outer end receives within the counter-bored large diameter section a housing sleeve 11, having a central bore 11*b*, best seen in FIG. 8 and FIG. 10, which is received with a close tolerance within the counter-bored outer section of the bore 10*b*, and which is held in place by a locking sleeve having an external thread on its outer surface which engages with an internal thread on the counter-bored large diameter section at the outer end of the bore 10*b*, thereby holding the housing sleeve 11 compressed between the inner end of the locking sleeve and an outwardly facing shoulder on the housing 10. In this configuration, the housing sleeve 11 essentially continues the inner surface of the bore 10*b* of the housing 10 that can be replaced as required by unscrewing the locking sleeve. The locking sleeve has a central bore coaxial with the bore 11*b* of the housing sleeve 11, so that the bore 10*b* continues through the locking sleeve and the housing sleeve 11.

Figure 13:
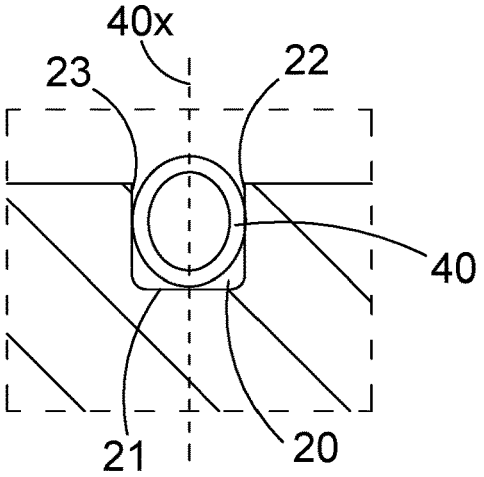
FIG. 13 shows an enlarged sectional view through a recess with a canted coil spring therein.

The inner surface of the housing sleeve 11 has a plurality of recesses in the form of circumferential annular grooves 20, best seen in FIG. 13, which are parallel to one another and which extend circumferentially around the whole of the inner surface of the bore 11*b*. Each groove 20 has a bottom wall 21 extending axially between inner and outer radially arranged and parallel sidewalls 22, 23, to form a generally square arrangement, optionally with rounded corners between the bottom wall 21 and the sidewalls 22, 23. Each groove 20 is open to the bore 11*b* of the housing sleeve 11 at an open inner end of the groove 20. In this example, the sidewalls 22, 23 are parallel, and are perpendicular to the bottom wall 21, which is parallel to the axis of the bore, but in other examples this geometry can be varied. In this example, the corners between the sidewalls 22, 23 and the bottom wall 21 are rounded, but again, this detail can be varied in other examples. Each groove is symmetrical around a radius of the bore (the radius extending perpendicular to the axis of the bore). Each groove thus has two alternative diagonals between opposite corners. In this example, all of the grooves have the same geometry.

Each groove 20 retains a garter-type coil spring in the form of a canted coil spring 40, best seen in FIG. 13. Canted coil springs 40 are known to the person skilled in the art, and are available from, among others, Bal Seal Engineering Inc. Suitable examples of canted coil springs are disclosed in U.S. Pat. Nos. 4,655,462, 4,826,144, 4,876,781, and 4,964,204, the disclosures of which are incorporated herein by reference.

Each spring 40 in this example is naturally coiled in an elliptical configuration with a cross section through the spring having a major axis 40*x* and a minor axis which is perpendicular to the major axis 40*x*, as best shown in FIG. 13, which shows the spring 40 in its resting configuration, expanding slightly out of the open end of the recess 20 since the major axis 40*x* of the spring 40 in the resting configuration is longer than the sidewalls 22, 23 and the diagonals between opposite corners of the recess 20. In the resting configuration shown in FIG. 13, the spring 40 is generally symmetrical with respect to the axis of the bore, although it naturally adopts the elliptical configuration with the major axis 40*x* and the minor axis perpendicular to it. The spring 40 is more resilient and allows greater flex along its minor axis than along its major axis 40*x*. In order to fit within the groove 20, the spring 40 is resiliently compressed, which stores energy in the spring 40, and causes the spring 40 to resiliently expand through the open end of the groove 20 e.g. once the compressive force acting on it has been removed.

Each canted coil spring 40 can therefore be energised in compression within its groove 20 (as shown in FIG. 1). When spring 40 is compressed in the recess and is energised, i.e. when the open end of the recess is covered, it can adopt one of two alterative elliptical configurations with the major axis 40*x* of the spring 40 canted across the long axis of the bore (i.e. non-parallel with the axis of the bore) at an angle between 0 and 90 degrees with respect to the bore when the recess is covered, so in each of the two alternative energised configurations, the major axis 40*x* of the spring 40 is generally aligned with one of the two diagonals of the recess connecting opposite inner and outer corners of the recess. See for example, the arrangement of the springs 40*a* and 40*b* in FIG. 4, which are at that point adopting alternative and different compressed configurations within their grooves 20, in general (but not necessarily exact) alignment with the two alternative diagonals of the grooves 20. The movement of the actuating member can shift the springs 40 between different configurations as will be described below.

The inner bore 11*b* of the housing sleeve 11 is very slightly smaller in ID than the inner bore of the locking sleeve immediately adjacent to it on its outer end and keeping the housing sleeve 11 in place within the outer section of the bore 10*b*. The bore of the housing sleeve 11*b* and the bore of the locking sleeve accommodate a support member which is optionally separate from the actuating member and in this example is optionally in the form of a support sleeve 50 which is cylindrical and is moveable axially within the bore 10*b* between separate positions. The support sleeve 50 has a central bore 50*b* allowing fluid passage through the support sleeve 50. The support sleeve 50 is divided into two sections having a common inner diameter but different outer diameters: namely an inner section which has a relatively narrow OD which can fit into the bore 11*b* of the housing sleeve 11; and an outer section, which has a larger OD that cannot fit into the bore 11*b* of the housing sleeve, but can be received within and can translate axially through the slightly larger bore of the locking sleeve. The outer section of the support sleeve 50 fits with a close tolerance in the bore of the locking sleeve, and this centralises the support sleeve 50 within the bore 11*b* of the housing sleeve so that the sleeves 50, 11 and the locking sleeve are all co-axial with the axis 10*x* of the bore 10*b*. When the inner section of the support sleeve 50 is located in the bore 11*b* of the housing sleeve 11, the springs 40 expand radially within the grooves 20 and engage the outer surface of the inner section of the support sleeve 50, which supports the springs 40 within the grooves 20 and maintains their compressed configurations within the grooves 20.

As the inner section of the support sleeve 50 moves axially within the bore 11*b* of the housing sleeve towards the outer end of the bore 10*b*, the support sleeve moves across the open ends of each of the grooves 20, uncovering them in sequence as it axially translates through the bore 11*b* in the first direction from right to left in the drawings. The OD of the inner section of the support sleeve 50 and the ID of the housing sleeve 11 are closely matched, with a close tolerance. Passage of the support sleeve 50 into the bore 11*b* from left to right in the drawings covers the open inner ends of the grooves 20 in sequence as it moves into the bore 11*b*, and uncovering them in the reverse sequence as it withdraws from the bore 11*b* from right to left. Thus, in different positions of the support sleeve 50, the open ends of some grooves 20 are covered, and the open ends of other grooves 20 are uncovered.

Uncovering the open end of a groove 20 accommodating a spring 40 allows expansion of an outer end of the canted coil spring 40 out of the groove 20 as the groove 20 is uncovered, which in this example can permit a change of configuration of the spring 40 in the groove 20. The change in configuration of the spring can occur in response to movement of the piston 30 or the support sleeve 50. Each canted coil spring 40 is resiliently held in compression within the groove 20, and upon uncovering the open end of a groove 20 the canted coil spring 40 expands and at least a part of the outer end of the canted coil spring 40 protrudes out of the groove 20.

The support sleeve 50 in this example is movable in each axial direction within the bore 10*b*, and the axial position of the support sleeve 50 within the bore 10*b* is optionally maintained by friction. Optionally some of the friction retaining the support sleeve 50 in place within the bore arises by drag between the inner surface of the locking sleeve abutting against the outer surface of the larger diameter outer section of the support sleeve 50, but optionally friction principally arises by the ends of the springs extending out of the grooves 20 in the housing sleeve 11 abutting against the outer surface of the inner section of the support sleeve 50 and retarding or resisting its axial movement relative to the springs. Therefore, axial force applied to the support sleeve 50 which overcomes the friction can cause the support sleeve 50 to axially translate relative to the grooves 20. Optionally the friction generated between the springs and the support sleeve can be increased by various ways, for example, by roughening the surface of the support sleeve, or by facing it with high friction coatings, or by creating formations on the surface of the support sleeve such as annular grooves to engage the ends of the springs that expand out of the recesses. Moving the springs out of engagement with the annular grooves requires additional axial force to be applied to the support sleeve. Frictional retardation of the movement of the support sleeve relative to the springs can be useful in resisting movement arising from normal vibration in use.

Figure 2:
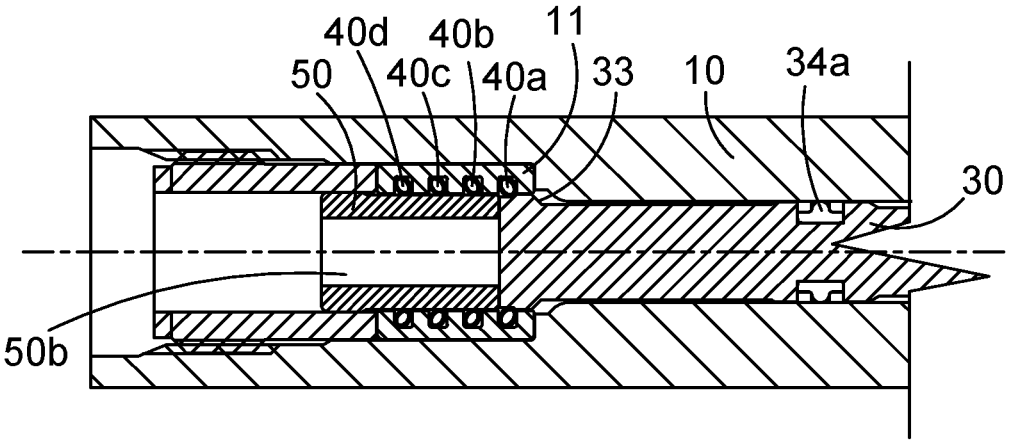
FIGS. 2-11 show enlarged views of the FIG. 1 arrangement in sequential positions of actuation.

To set up the assembly for actuation, the support sleeve 50 is initially pressed into the bore 10*b* in the second direction, from left to right in the drawings, such that the inner section of the support sleeve 50 moves through the bore 11*b* from the outside of the bore (left hand side in the drawings) to the inside of the bore (right hand side in the drawings) until the inner end of the inner section of the support sleeve 50 abuts the outer face 30*o* of the piston 30 as shown in FIG. 1 and FIG. 2. In reaching this configuration, the OD of the support sleeve 50 has moved from left to right across all of the open ends of the grooves 20 housing springs 40*d*, 40*c*, and 40*b*. This has moved the protruding outer ends of the springs 40*d*, 40*c* and 40*d* towards the inner end of the bore, so as they compress within their respective grooves 20, they adopt the first compressed canted configurations shown in FIG. 1 generally aligned with one diagonal, with their outer ends pushing out of the groove 20 furthest from the outer end of the bore 10*b* and closer to the shoulder 31 (and facing towards it in an axial direction), while the inner ends are trapped in an inner end corner of the groove, closer to the outer end of the bore 10*b* and further away from the shoulder 31 than the outer ends of the springs. Since the movement of the support sleeve 50 from left to right (the second direction) is compressing the springs along their minor axes rather than their major axes, they compress into the grooves 20 with substantially little resistance, or at least with insufficient resistance to stop the progress of the support member 50 through the bore in the second direction. Initially the support sleeve 50 is moved inwards past the position shown in FIG. 1, to sweep past the first spring 40*a* also, and to move it into the first canted configuration shown in FIG. 1 in uniformity with the other springs 40*b,c*, and *d*. While moving inwards, the inner end of the support sleeve 50 is eventually pressed against the outer end 30*o* of the piston head 30*h*, so that the nose 32 on the piston is contiguous with the support sleeve 50 as it passes the innermost groove holding the spring 40*a* when completing the stroke. When the spring 40*a* has adopted the first compressed and canted configuration shown in FIG. 1, the force pushing the support sleeve 50 is reduced, allowing the piston 30 to push the support sleeve 50 ahead of it in the first direction, from right to left in the drawings, out of the bore 10*b* to the FIG. 1 position.

In FIG. 1, the innermost (first) groove on the inner end of the bore 11*b* housing spring 40*a* is shown axially aligned with the nose 32 of the outer end of the piston 30, which has a very slightly narrower OD than the adjacent inner section of the support sleeve 50.

Figure 3:
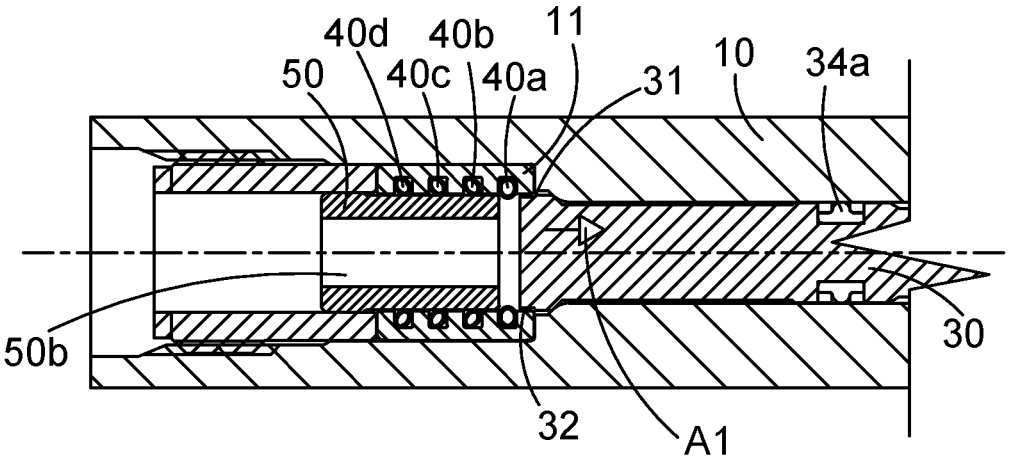
Figure 6:
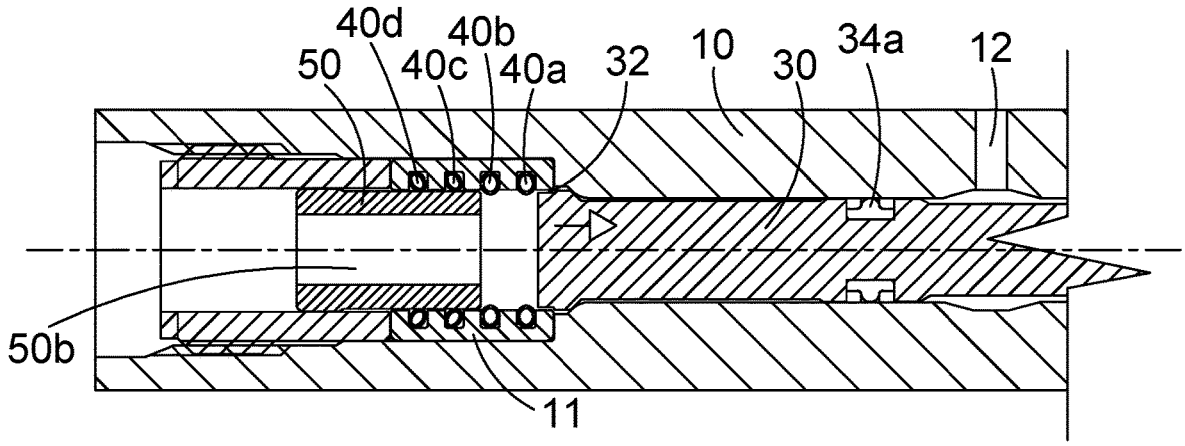

The narrower diameter of the nose 32 of the piston 30 means that the outer surface of the nose 32 is spaced radially by a small distance from the inner wall of the housing sleeve 11, as best seen in FIGS. 3, 6 and 8 so that the outer ends of the springs 40 can expand radially out of the grooves 20 across the small radial distance between the housing sleeve 11 and the nose 32, and bear against the nose 32. Also, because the nose is narrower than the support sleeve, the springs 40 can track over the step transition from the support sleeve 50 to the nose 32 without arresting the axial movement of the piston 30 in the bore, as the springs 40 merely expand a little further out of the grooves 20 when transitioning the step between the support sleeve 50 and the nose 32, while still retaining their compressed and canted configurations in the grooves. The nose 32 supports the springs within the grooves 20, maintaining the compressed configurations of the springs 40 within the grooves 20 and keeping them resiliently energised, but allowing slight expansion of the outer ends of the springs 40 out of the boundaries of the open end of the groove 20 when engaged with the nose 32 of the piston 30.

When the support sleeve 50 is pushed back out of the bore 10*b* in the first direction by the piston 30 at the initial cycle, the spring 40*a* experiences a slight "bump" when the outer end of the spring 40*a* transitions between the OD of the support sleeve 50 onto the smaller OD of the slightly narrower nose 32. This is sufficient to allow the spring to expand slightly out of the groove to press against the nose 32, but the expansion is not sufficient to allow the spring 40*a* to change its configuration in the groove 20, hence it remains in the same canted compressed first configuration but slightly expanded as best shown in FIG. 2 (a close up of FIG. 1).

As can be seen in FIG. 1 and FIG. 2, in the initial configuration ready for actuation, each spring 40 is energised in its groove 20 and adopts an energised elliptical configuration with the major axis 40*x* of the spring canted across a radius of the axis 10*x* of the bore 10*b*. Two different alternative energised (compressed) elliptical configurations of each spring 40 are possible in each groove 20, with the outer end of the major axis 40*x* of the canted spring 40 being canted either in one direction across the radius towards the shoulder 31 or in the opposite direction away from the shoulder 31, and with the major axis 40*x* of the spring 40 generally (but not necessarily exactly) parallel to or aligned with one of the two diagonals of the groove 20, between opposite corners of the groove 20, and the minor axis of the spring 40 being parallel to or aligned (generally and not necessarily exactly) with the opposite diagonal of the groove 20.

The present example will be explained with reference to the two ends of the major axis 40*x* of the spring. These are best understood as inner and outer ends of the spring 40. The inner end of the spring 40 is normally contained in the inner end of the groove 20. The outer end of the spring 40 is generally being urged out of the open end of the groove 20.

In this example, the direction of actuating movement of the piston 30 in the first direction is out of the bore 10*b* from right to left. In this example, the piston 30 bears the shoulder 31 (in other examples the shoulder could be static on the housing) and so the direction of movement of the piston shoulder 31 in this example is also from right to left in the first direction as shown in the transition between the positions in FIGS. 1 and 13, in which FIG. 1 is closed with the piston 30 fully withdrawn into the bore 10*b*, and FIG. 13 is open with the piston 30 fully extended out of the bore 10*b*.

Thus when the piston is moving in the first direction, out of the bore from right to left in the drawings, the inner end of the major axis 40*x* of the spring 40 is the end closest to the outer part of the bore and furthest from the shoulder 31 (and facing axially away from it), and the outer end of the spring is the end furthest in the bore and closest to the shoulder 31 (and facing axially towards it), so that the outer end generally faces the shoulder 31. Of course, the actual direction of movement of the actuating member in different examples can be modified, and the details recited here concerning directions and orientations such as left and right etc. are purely for the illustration of this particular example, and should not be regarded as being a restriction in the scope of the present disclosure as it applies to other examples.

Before adopting the FIGS. 1 and 2 configuration, a reset stroke of the support sleeve 50 from left to right has swept the protruding outer ends of the springs 40 along in the same direction, so the major axis 40*x* of each spring 40 in FIGS. 1 and 2 has an inner end disposed in the groove 20 facing the outer end of the bore and spaced radially further from the axis of the bore than the outer end of the spring protruding from the groove 20 through the open end of the groove 20, facing the inner end of the bore and the shoulder 31. The inner end of the spring 40 is further from the shoulder 31 than the outer end of the spring 40. In this first configuration, each spring 40 resists further compression along its major axis 40*x*. This can be used to resist axial movement of the piston 30 in a first direction (e.g. out of the bore, from right to left in the present example).

In the first canted compressed configuration shown in FIG. 2, the inner end of the major axis 40*x* of the spring 40*a* faces in an axial direction away from the piston shoulder 31 and towards the outer end of the bore 10*b* and is disposed in an inner corner of the groove 20, between the bottom wall and the sidewall ahead of the piston shoulder 31. The outer end of the major axis 40*x* of the spring 40*a* is protruding from the groove 20 in front of the piston shoulder 31, facing in an axial direction towards the piston shoulder 31 and closer to it than the inner end of the spring 40*a*. The spring 40*a* is held in this first configuration, in compression along its major axis by the nose 32 of the piston, which has a smaller OD than the plateau section of the piston head 30*h*, which is separated from the nose 32 by the acutely angled shoulder 31. As the piston 30 moves in the bore in a first direction from right to left, the shoulder 31, which is spaced from the leading end of the piston 30, moves towards the outer end of the bore 10*b*, and eventually engages with the outer end of the major axis 40*x* of the spring 40*a* that is protruding from the groove 20 in front of the shoulder 31. As the shoulder 31 moves axially in the first direction, the outer end of the spring 40*a* rides along the nose 32 until it reaches the transition between the nose 32 and the shoulder 31. The relatively steep angled step between the nose 32 and the shoulder 31 prevents the spring from riding up the shoulder 31 and compressing, because the spring 40*a* is highly resistant to deformation along the major axis 40*x*. Thus, the piston can translate axially as long as the outer end of the spring 40*a* is compressed against the smooth and axis-parallel nose 32; however, when the shoulder 31 on the piston engages the outer end of the major axis 40*x* of the spring 40 protruding from the groove 20 in the first configuration, the spring 40*a* cannot compress further into the groove 20 along its major axis 40*x* and resists further movement of the shoulder 31 (and hence the piston 30) in the first direction (e.g. out of the bore from right to left in this example). Since the inner end of the spring 40*a* is trapped in the corner of the groove 20 ahead of the shoulder 31, the spring 40 cannot move along its axis in the groove 20, nor shift within the groove 20 to permit greater deformation in a different configuration. The high resistance to deformation along the major axis 40*x* of the spring 40*a* trapped between the inner corner of the groove 20 and the shoulder 31 therefore restricts movement of the piston 30 in the first direction past the point when the nose 32 on the leading end of the piston 30 covers the groove 20 and the shoulder 31 on the piston 30 engages the outer end of the spring 40*a* protruding from the groove 20. At this point the piston 30 can withdraw in the opposite second direction in the bore (see the arrow A1 in FIG. 3) but cannot move forward past the FIG. 2 point without disrupting (i.e. breaking) the spring 40*a*, for example, compressing it beyond its limit of plastic deformation and irreversibly deforming it.

Withdrawal of the piston 30 back into the bore in the second direction as is shown in the transition from FIG. 2 to FIG. 3 drives the piston backwards from left to right into the bore 10*b* to uncover the open end of the first groove housing the first spring 40*a*, and drives the ramp 33 backwards against an outwardly facing shoulder on the bore 10*b* which limits the axial travel in the second direction (in the direction of the arrow A1 shown in FIG. 3). In this position, the seals 34*a, b* and *c* still isolate the inlet and outlet 12, 13, and prevent any fluid flow therethrough. Axial movement of the piston 30 is driven in this example by applying fluid pressure differentials through the bore 10*b* across the piston 30, which are transmitted from outside the bore via a pump (not shown) in fluid communication with the outer end of the bore 10*b*. The fluid pressure is transmitted through the bore 50*b* of the support sleeve 50, which does not react to changes in pressure and remains in position (due to friction principally between the support sleeve 50 and the springs 40) when the piston 30 withdraws into the bore in the second direction. As the piston 30 withdraws in the second direction and the support sleeve 50 remains static, the open end of the groove housing spring 40*a* is uncovered so the spring 40*a* is unsupported on its ID and therefore expands into the bore 11*b* into a resting or neutral configuration. In the resting or neutral configuration of the spring 40*a*, the major axis 40*x* of the spring 40*a* is not substantially canted across the axis of the bore and the spring 40*a* is expanded partially into the bore and out of the groove 20, in a generally symmetrical configuration around a radius of the bore as shown in FIG. 3 and FIG. 13. The spring 40*a* is no longer forced to adopt the first canted energised configuration shown in FIG. 1, and adopts the neutral configuration of FIGS. 3 and 13. In the neutral configuration, the spring 40*c* can now be shifted, e.g. rotated, in the groove 20. This allows the spring 40*a* to flip to a second energised canted configuration as will now be described, driven in this case by the return movement of the piston 30 axially within the bore 11*b* in the first direction.

When the fluid pressure acting on the piston 30 to keep it in the FIG. 3 position is reduced so that the force from the fluid pressure is below the force of the spring 35, the piston 30 is urged out of the bore 10*b* by the spring 35, moving once more in a first direction from right to left in the drawings (see the arrow A2 in FIG. 4). As the nose 32 of the piston 30 sweeps past the open inner end of the groove housing the first spring 40*a*, the piston 30 pushes the unsupported and protruding outer end of the spring 40*a* in the first direction, into an alternative second energised canted configuration of the spring 40*a* with the inner end of the major axis 40*x* of the spring 40*a* disposed in the groove 20 axially closer to the shoulder 31 approaching it from the right in the drawings, and the outer end of the major axis 40*x* of the spring 40*a* protruding from the groove 20 (radially closer to the bore than the inner end) pointing away from the shoulder 31 towards the outer end of the bore and axially further away from the shoulder 31 than the inner end of the spring 40*a*, reaching the configuration shown in FIG. 4, in which the major axis 40*x* of the spring 40*a* is now aligned with the opposite diagonal in the groove 20 as compared with the configuration shown in FIG. 2.

The shoulder 31 again engages with the outer end of the spring 40*a* protruding from the groove 20, but because the spring 40*a* has shifted orientation from the first to the second configuration in the groove 20, the shoulder 31 compresses the minor axis rather than the major axis 40*x*. Since the minor axis of the spring 40 is more compressible than the major axis 40*x*, continued forwards movement of the shoulder 31 in the first direction of the arrow A2 shown in FIG. 4 past the FIG. 4 position presses the shoulder 31 against the rear face of the outer end of the spring 40 protruding from the open end of the groove 20 and compresses the spring 40 into the groove 20 by applying force along the minor axis of the spring 40, pressing the spring 40 further into the groove 20, and permitting passage of the shoulder 31 of the piston 30 past the groove 20 and the compressed spring 40*a*. The spring 40*a* remains in the second canted compressed configuration as shown in FIG. 4 as the piston head 35 translates axially in the first direction (in the direction of the arrow A2 in FIG. 4). At about the same time as the piston head 30*h* compresses the outer end of the spring 40*a*, the outer end 30*o* of the piston re-engages the inner end of the static support sleeve 50, still in the same position from the previous cycle, and further axial translation of the piston 30 in the first direction (in the direction of the arrow in FIG. 4) pushes the support sleeve 50 further outwards in the bore 10*b* to the FIG. 5 position. The spring 40*b* experiences the same "bump" when transitioning the slight inward step in OD between the support sleeve 50 and the nose 32, but remains in the same first compressed canted configuration as shown in FIG. 5, with a slightly more pronounced expansion out of the groove 20 than the springs 40*c* and 40*d*.

Thus it can be seen that moving the piston 30 across the free end of a groove 20 first in one direction and then in the opposite direction can shift the spring 40*a* within the groove from one compressed canted position to a neutral position, and then to an opposite compressed canted position. Shifting the spring 40*a* between different canted configurations, from a first configuration in which the spring 40*a* engages with the piston 30 and resists passage of the piston 30 past the groove 20, to a second configuration in which the spring 40*a* engages with the piston 30 and permits passage of the piston 30 past the groove 20 holding the spring 40*a* can be used to stop the movement of the piston 30 in defined positions in the bore, for example, at the boundaries of the grooves, and control more precisely different indexed stop locations of the piston 30 in the bore defining the intermediate positions between open and closed configurations.

Figure 4:
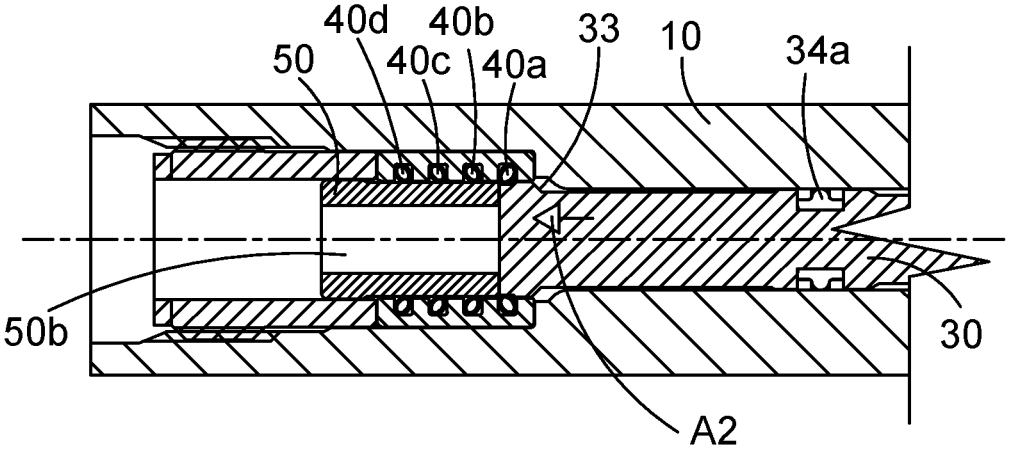
Figure 5:
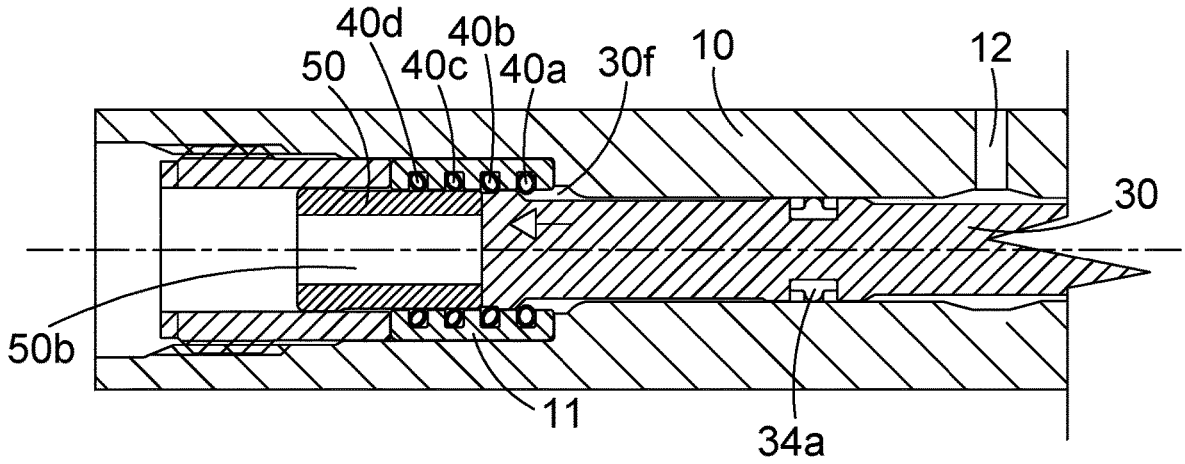

After compressing the outer end of the spring 40*a* into its groove, the piston 30 moves past the FIG. 4 position under the force of the expanding spring 35, pushing the support sleeve 50 ahead of it in the bore 10*b* in the first direction shown in FIG. 5, to the position shown in FIG. 5. Here the configuration is essentially the same as in FIG. 2, but moved along one groove 20 towards the outer end of the bore 10*b*. As in the FIG. 2 configuration, the spring 40*b* adopts the first canted compressed configuration shown in FIG. 5, with an inner end of the major axis 40*x* of the spring 40*b* facing in an axial direction away from the piston shoulder 31 and disposed in an inner corner of the groove 20, between the bottom wall and the sidewall ahead of the piston shoulder 31 and further from the piston shoulder 31 than the outer end of the spring 40*b*, and the outer end of the major axis 40*x* of the spring 40*b* protruding from the groove 20 in front of the piston shoulder 31, facing in an axial direction towards the piston shoulder 31 and closer to it (in an axial direction) than the inner end. The spring 40*b* is resiliently held in compression by the nose 32 of the piston, and as the piston 30 moves in the bore in a first direction from right to left, the shoulder 31 engages with the outer end of the major axis 40*x* of the spring 40*b* that is protruding from the groove 20 in front of the shoulder 31. The steep angle at the shoulder 31 acts as a stop, and the high resistance to deformation along the major axis 40*x* prevents or resists further movement of the piston 30 in the first direction past the FIG. 5 point when the nose 32 on the leading end of the piston 30 covers the groove 20 and the shoulder 31 on the piston 30 engages the outer end of the spring 40 protruding from the groove 20, in generally the same way as explained for the FIG. 2 configuration, but moved along by one spring 40. At this point the piston 30 can withdraw in the opposite second direction in the bore (see the arrow in FIG. 6) but cannot move forward out of the bore past the FIG. 5 point. Notice that at the FIG. 5 point, the spring 40*a* is not compressed as it is axially aligned with a free space 30*f* in the annulus between the bore 10*b* and the piston 30 behind the ramp 33 on the piston head 30*h*, and hence the spring 40*a* adopts a non-compressed neutral position in its groove. This presents no substantial resistance to passage of the piston 30 in either direction past the spring 40*a*.

A fluid pressure increase in the outer part of the bore 10*b* again drives the piston 30 in the second direction back into the bore 10*b* to reach the position shown in FIG. 6, which uncovers the open ends of the grooves housing the two springs 40*a* and 40*b*, which then both adopt the same neutral position, and can then be rotated in their grooves 20 and/or passed by the piston 30 without substantial resistance as previously described. The head 30*h* of the piston 30 can easily compress the springs 40*b* and 40*a* into their grooves as they are in the neutral position. The FIG. 6 configuration is the same as FIG. 3, with the piston 30 unable to move any further in the second direction, except that the support sleeve 50 has moved further along the row of grooves 20 towards the outer end of the bore 10*b*, and has uncovered both of the grooves housing springs 40*a* and 40*b*. The support sleeve 50 remains where it is when the piston 30 moves away from it in the second direction, due to friction between the support sleeve 50 and the springs 40.

Figure 7:
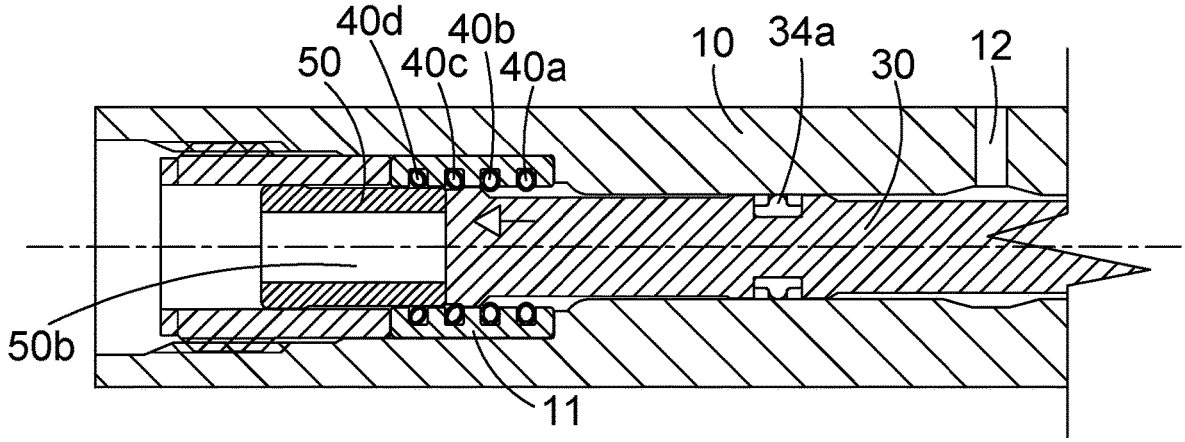

From the position shown in FIG. 6, fluid pressure is then reduced again allowing the spring force to return the piston 30 in the first direction as shown in FIG. 7, until the nose 32 underlies the spring 40*c*, which abuts the shoulder 31 of the piston 30. This position is held for the same reasons as explained above with respect to FIGS. 2 and 5, as the shoulder 31 abuts the outer protruding end of the spring 40*c* and can go no further in the first direction because of the high resistance to compression of the spring 40*c* while it is in its first configuration. The piston 30 is again reset to the FIG. 8 configuration by increasing fluid pressure to overcome the spring force as described with respect to FIG. 6 and to move the piston 30 back into the bore 10*b* in the second direction as shown by the arrow in FIG. 8 to the stop position.

Note that the piston 30 has been translating in alternating first and second directions, being stopped from moving in the first direction at each spring 40 when the spring 40 is in the first compressed configuration with the outer end protruding from the groove and closer to the shoulder 31, but passing each spring in the first direction without substantial resistance (in each direction) when the spring 40 was either in a neutral or a second compressed configuration, because each of these configurations could be compressed into the groove by compression of the spring along its minor axis, whereas those springs in the first configuration resist compression into the groove along their major axes and therefore act as a stop. Notice that in each transition, the piston advances axially in a stepwise manner further in the first direction out of the bore 10*b* than was possible in the previous transitions, and that the stopping or indexing position is dictated by the position of the grooves 20. So far, this has not led to any change in the actuation status of the assembly, because although the seals 34*a, b* and *c* on the piston 30 have moved axially with the piston 30 in the bore 10*b*, they have remained compressed in the annulus between the bore 10*b* and the piston 30 on opposing sides of the inlet 12 and outlet 13, and hence are still isolating the inlet 12 from the outlet 13, albeit that seal 34*c* is closer now to outlet 13 than it was previously, and seal 34*b* is closer now to inlet 12. Notice also that the shoulder 31 on the piston 30 acts as a unidirectional stop for the actuating member, reacting with the springs to stop movement in the first direction if the spring ahead of it is in the first configuration but allowing movement in the second direction in each configuration of the springs.

Figure 9:
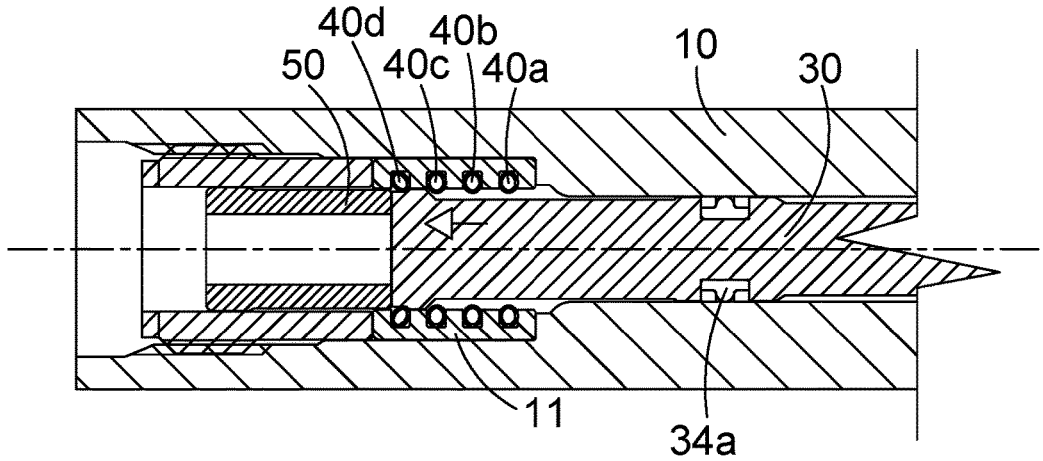

In the next cycle the fluid pressure is reduced in the FIG. 8 configuration and the spring force returns the piston 30 to the FIG. 9 configuration. The seal 34*b* is now relatively close to the groove 12*g* surrounding the inlet 12, but is still compressed and still resists fluid communication between the inlet and the outlet 12, 13. The piston 30 reaches its maximum limit of travel in the first direction (of the arrow shown in FIG. 9) when the shoulder 31 abuts the outer protruding end of the spring 40*d*, and fluid pressure is then increased again from the pump to drive the piston 30 back into the bore 10*b* to the FIG. 10 arrangement, which is the final cycle before actuation of the valve 1. As before, the piston 30 has pushed the support sleeve 50 past the groove housing the final spring 40*d*, which is now unsupported as the support sleeve 50 remained in position when the piston retracted to the FIG. 10 position.

Note that in each cycle, the elongate extension of the nose 32 has pushed the support sleeve 50 past the groove housing the spring in the first compressed configuration that stops the piston. Thus, in each cycle, when the piston has moved in the bore, it has pushed the support sleeve 50 between its different positions, and has removed the support of the support sleeve 50 from the open end of the recess, one spring at a time. Thus, when the nose 32 retracts into the bore 10*b* following the stop at the spring, the spring 40 is shifted from its first compressed configuration, in which it can stop the spring from axially advancing in the bore in the first direction, to a neutral position in which the spring 40 allows passage of the piston 30 in each direction without substantial resistance.

Figure 11:
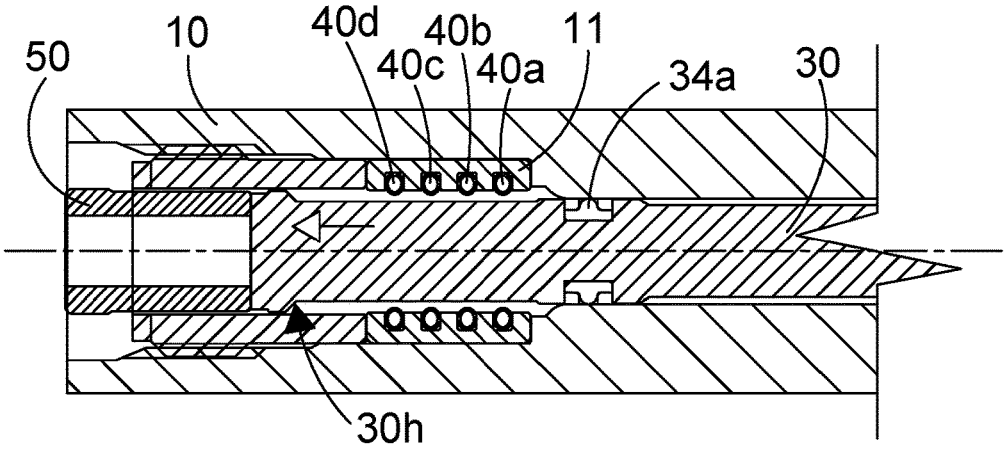

Thus, in the final cycle between the FIG. 10 and FIG. 11 positions, when the fluid pressure is reduced, the spring force pushes the piston 30 axially through the bore 10*b* past all of the springs 40*a, b, c* and *d*, which are all in the neutral position and offer little or no resistance to the passage of the piston 30. Thus the piston 30 moves under the force of the compressed spring 35 until the seal 34*b* enters the groove 12*g* at the inlet, and loses its sealing function as it is no longer compressed by opposing walls. There is now a fluid pathway open between the inlet 12 and outlet 13, although leaks at the two ends of the piston 30 are still prevented by seals 34*a* and 34*c*. Hence, while the assembly is in the FIG. 11 and FIG. 13 position (which are the same) the valve is open and fluid can flow from the inlet 12 to the outlet 13.

The valve 1 can be reset by moving the support sleeve 50 (which pushes the piston ahead of it) axially back into the bore in the second direction (shown by the arrow A1 in FIG. 3) in a reset stroke until the inner end of the support sleeve 50 has swept past the groove housing the spring 40 *a* and the ramp 33 has shouldered out on the housing as shown in FIG. 3, and all springs 40 *a, b, c*, and *d* have been reset into their first compressed canted configurations shown in FIG. 1, and are supported from within by the support sleeve 50. Optionally the support sleeve can be moved by a piston (which can be integral to the support sleeve or can be a separate item, and which can optionally incorporate differential sealed areas) which can be activated by a separate control line providing fluid pressure to move the support sleeve axially in the bore 10 *b*. Once the springs 40 have been reset past the FIG. 1 positions, the pressure can be released, and the piston 30 will return the assembly under the force of the spring 35 to the FIG. 1 position, where it is restrained by the first compressed canted configuration of the spring 40 *a*.

In the present example, the different intermediate axial positions adopted by the piston 30 within the bore 10*b* are used as indexing points which do not, in this example, trigger different configurations of the inlet and outlet, but which advance the assembly to the final position in which the configurational change is triggered in the transition between the positions in FIG. 10 and FIG. 11. However, in other examples, each position of the piston 30 could effect a different configurational change in the assembly. In some examples, a tool can be connected to the actuator assembly and can operate under its control. For example, the separate positions of the actuator member could correspond to separate states of actuation of the downhole tool. In one example, the piston 30 can itself comprise a part of the tool, for example a component of a sliding sleeve valve system, which slides axially within the housing in order to move respective apertures in a sliding sleeve attached to the piston 30 in and out of alignment with a flowpath controlling flow of fluid, or to vary the extent of overlap of such apertures in order to increase or decrease the cross-sectional area of a fluid conduit thereby gradually increasing or decreasing fluid flow in a stepwise manner at each position.

Referring now to FIGS. 15-22, a second example of an actuator assembly in the form of a valve 101 has features similar to the valve 1, which are referenced with the same number but increased by 100. The skilled person is directed to the first example described herein for a full description of similar parts. The valve 101 has a fixed member in the form of a housing 110, with a tubular bore 110*b* which receives an actuating member in this example taking the form of a piston 130 which is centralised within the bore 110*b* and sealed in the bore as previously described. The inner end of the bore is substantially the same as the valve assembly 1. The differences between the first and second examples generally relate to the outer end of the bore and the head of the piston.

Whereas in the first example, the shoulder is located on the actuating member of the piston and the recesses and springs are located on the fixed member of the housing. In the second example, these are reversed, and the shoulder is located on the fixed member of a housing sleeve, while the recesses and springs are located on the actuating member of the piston.

In the second example, the inward travel of the piston 130 is limited by respective opposing chamfered edges on the outer end of the piston 130 and a housing sleeve 111. The housing sleeve 111 is secured to the housing 110 by a screw thread, and has a shoulder 131 similar to the shoulder 31 in the first example, but facing in the opposite direction, towards the inner end of the bore 110*b*. The housing sleeve 111 has a central bore which is coaxial with the bore 110*b* of the housing 110.

The outer surface of the piston 130 has a plurality of recesses in the form of circumferential annular grooves 120 having a similar geometry to the grooves 20. Each groove

120 retains a garter-type coil spring in the form of a canted coil spring 140 essentially as described for the first example.

The open end of the bore 110*b* has a counterbore defining an outwardly facing shoulder 110*s*, and creating an annular area between the inner surface of the housing 110, the outer surface of the piston 130, the shoulder 110*s*, and the housing sleeve 111, which encloses the outer end of the annular area. The support sleeve 150 has a co-axial bore which accommodates the piston 130 and allows the support sleeve to move axially in each direction with respect to the piston 130 and the housing 110. The support sleeve 150 is captive within the annular area inside the bore, which is closed at inner and outer ends of the bore by the shoulder 110*s* and housing sleeve 111 respectively. As previously described, the axial position of the support sleeve 150 is optionally maintained by friction between the support sleeve 150 and the springs 140.

Figure 15:
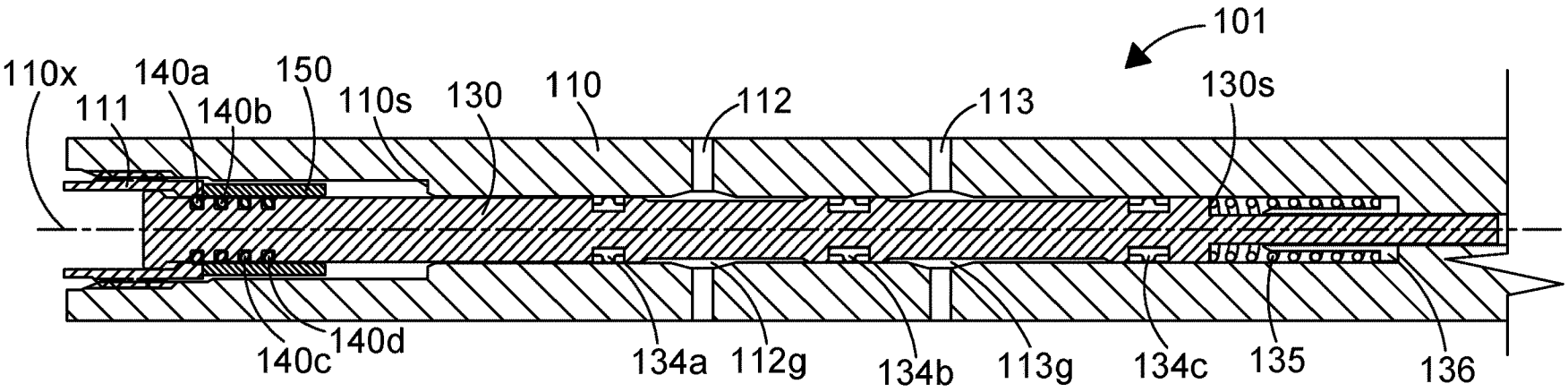
FIGS. 15-18 show a second example of an actuator assembly in sequential positions of actuation.

To set up the assembly for actuation, the piston 130 is pressed into the bore 110*b* in the second direction, from left to right in the drawings. The outer end of the shoulder 131 on the housing sleeve 111 has a ramp similar to the ramp 33 on the first example, which slides across all of the open ends of the grooves 120 housing springs 140*a-d*. This has moved the protruding outer ends of the springs towards the outer end of the bore, so as they compress within their respective grooves 20, they adopt the first compressed canted configurations shown in FIG. 15 generally aligned with one diagonal, with their outer ends pushing out of the groove 120 furthest from the inner end of the bore 110*b* and closer to the shoulder 131 (and facing towards it in an axial direction), while the inner ends are trapped in an inner end corner of the groove, closer to the inner end of the bore 110*b* and further away from the shoulder 131 (and facing axially away from the shoulder 131) than the outer ends of the springs. This motion is compressing the springs along their minor axes rather than their major axes, so they compress into the grooves 120 with substantially little resistance. While moving inwards, the chamfered face on the inner end of the piston 130 is eventually pressed against the ramp on the outer end of the housing sleeve 111. The support sleeve 150 can be urged into the FIG. 15 position at this point by fluid pressure or the like during resetting, and maintains the springs 140*a-d* in this first canted configuration. Optionally the support sleeve 150 can be pinned in the FIG. 15 position during assembly by a pin extending radially through the wall of the housing 110, keeping the support sleeve 150 in the FIG. 15 position during insertion of the piston 130, after which the pin can be removed. When all springs 140 have adopted the first compressed and canted configuration shown in FIG. 15, the fluid pressure forcing the piston 130 inwards into the bore 110*b* is reduced, allowing the spring 130*s* to drive the piston 130 in the first direction, from right to left in the drawings, out of the bore 10*b* to the FIG. 15 position. Friction between the springs 140 and the support sleeve 150 ensures that the position of the support sleeve 150 remains as shown in FIG. 15 as the piston 130 is extended out of the bore 110*b* from right to left under the force of the spring 135. Optionally the support sleeve 150 can be moved axially during or after reset operations by a separate control line providing fluid pressure. Optionally the support sleeve 150 can be restrained in the FIG. 15 position during resetting, for example, by fluid pressure from such a control line.

Figure 20:
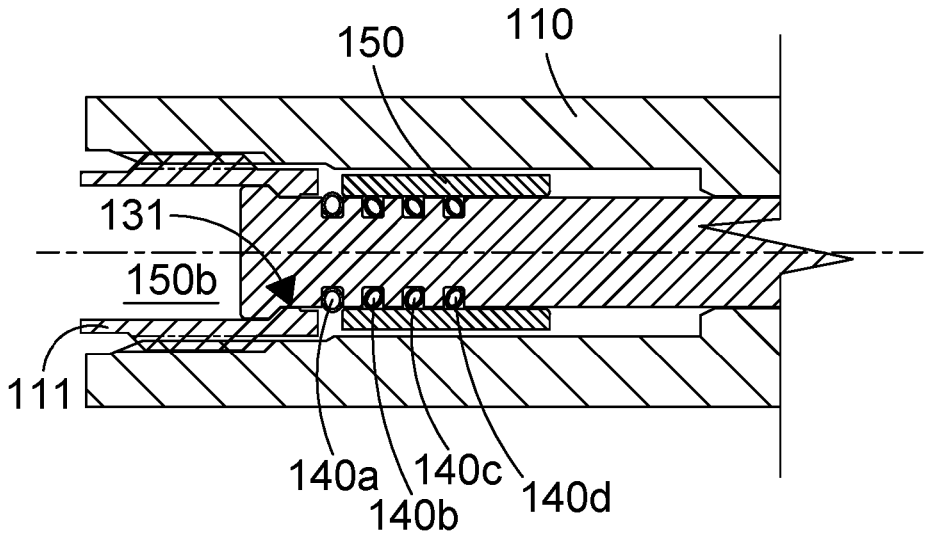
Figure 21:
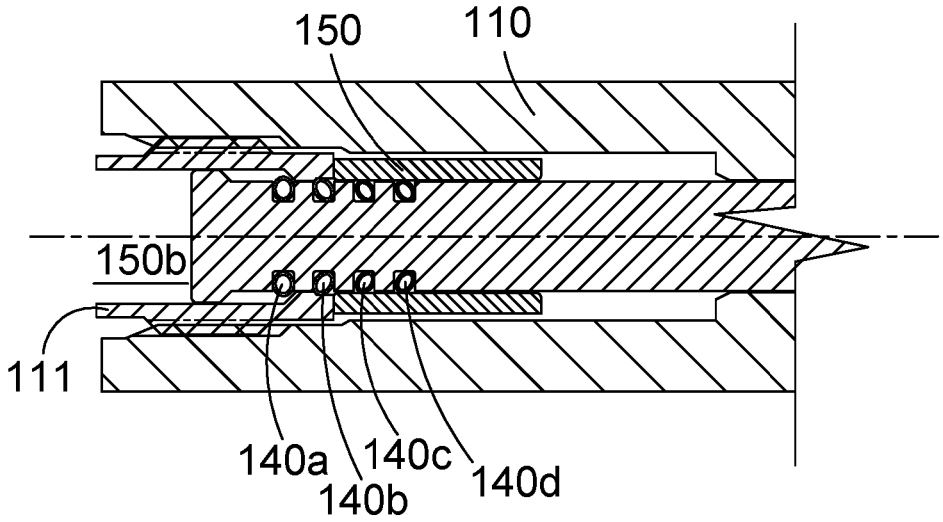
Figure 22:
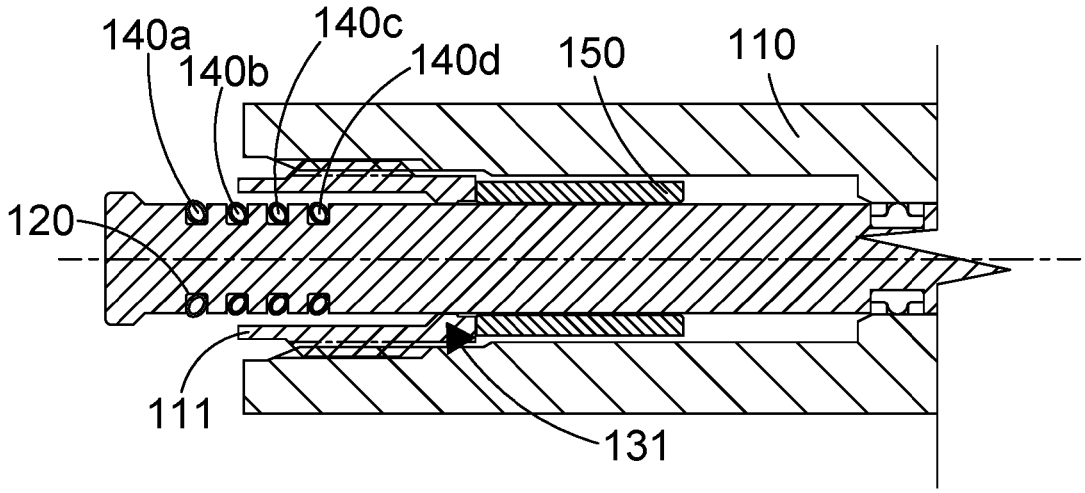

In FIG. 15, the outermost (first) groove on the outer end of the piston 130 housing spring 140*a* is shown axially aligned with the nose of the inner end of the housing sleeve 111, which has a very slightly narrower OD than the adjacent inner section of the support sleeve 150 (as best seen in FIG. 20). The narrower diameter of the nose allows the outer ends of the springs 140 to expand radially out of the grooves 120 across the small radial distance between the piston 130 and the housing sleeve 111, and bear against the nose, essentially as described for the previous example. The nose supports and compresses the springs within the grooves, but allowing slight expansion from the open ends of the grooves 120 as previously described.

In the initial configuration ready for actuation, each spring 140 adopts an energised elliptical configuration. A reset stroke of the piston 130 has set the springs 140 in the first configuration, with the major axis of each spring 140 having an inner end disposed in the groove 120 facing the inner end of the bore and spaced radially closer to the axis of the bore than the outer end of the spring protruding from the groove 120 through the open end of the groove 120, facing the outer end of the bore and the shoulder 131. The inner end of the spring 140 is further away (in an axial direction) from the shoulder 131 than the outer end of the spring 140. In this first configuration, each spring 140 resists further compression along its major axis as previously described. Thus in the first canted compressed configuration shown in FIG. 15, the inner end of the major axis of the spring 140*a* faces in an axial direction away from the shoulder 131 and towards the inner end of the bore 110*b* and is disposed in an inner corner of the groove 120, between the bottom wall and the sidewall facing the shoulder 131. The outer end of the major axis of the spring 140*a* is protruding from the groove 120, facing in an axial direction towards the shoulder 131 and closer to it than the inner end of the spring 140*a*. The spring 140*a* is held in this first configuration, in compression along its major axis by the nose. As the piston 130 moves in the bore in a first direction from right to left, the shoulder 131 engages with the outer end of the major axis of the spring 140*a* that is protruding from the groove 120 facing the shoulder 131, and in this arrangement, the spring 140*a* cannot compress further into the groove 120 along its major axis and resists further movement of the shoulder 131 (and hence the piston 130) in the first direction (e.g. out of the bore from right to left in this example). The piston 130 can withdraw in the opposite second direction in the bore but cannot move forward past this point without disrupting (i.e. breaking) the spring 140*a*.

Figure 16:
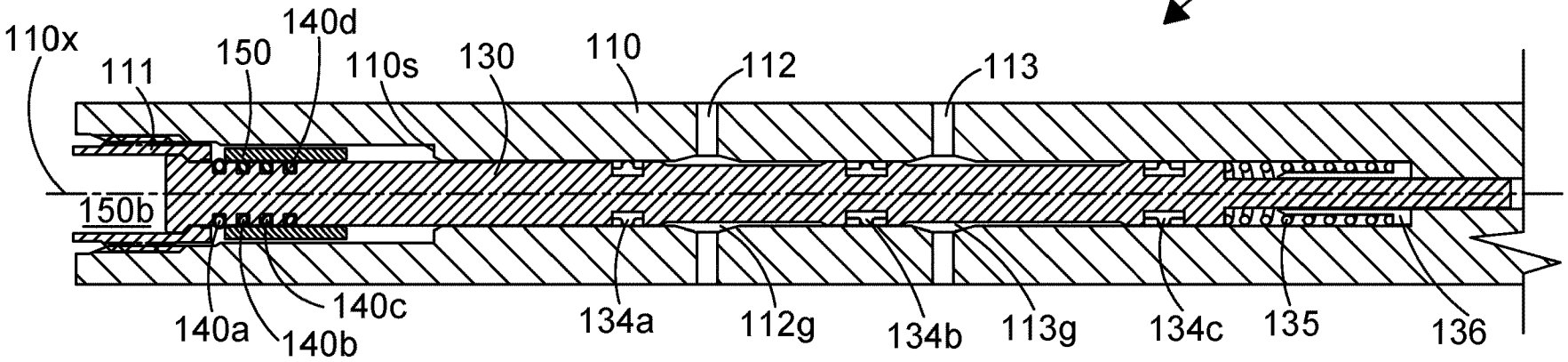
Figure 17:
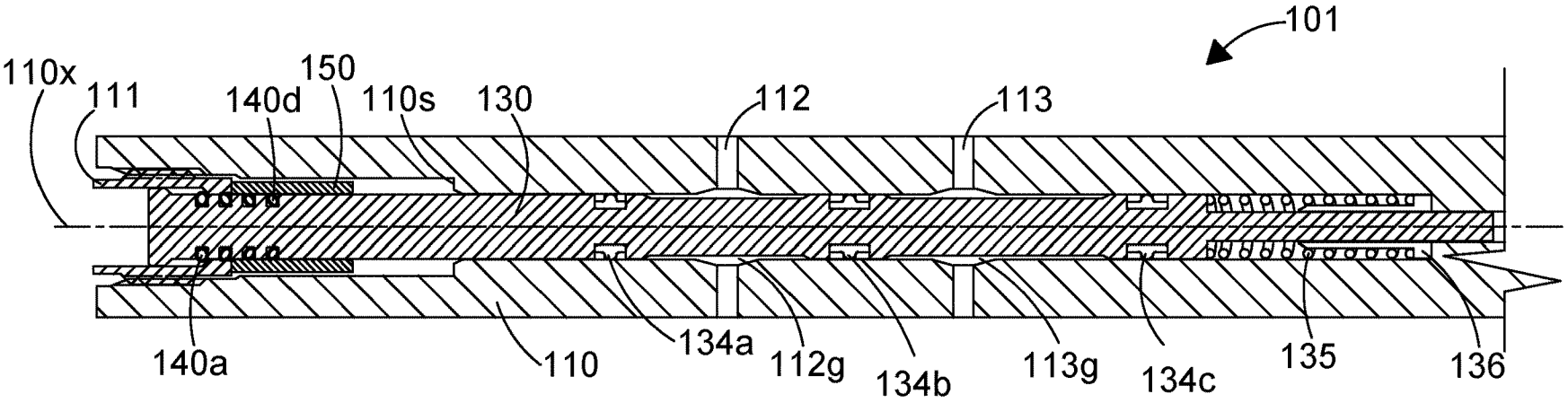

Withdrawal of the piston 130 back into the bore in the second direction as is shown in the transition from FIG. 15 to FIG. 16 drives the piston backwards from left to right into the bore 110*b* to uncover the open end of the first groove housing the first spring 140*a*, and drives the chamfered edges of the piston 130 and housing sleeve 111 together, which limits the axial travel in the second direction. In this position, the seals 134*a, b* and *c* still isolate the inlet and outlet 112, 113, and prevent any fluid flow therethrough. As the piston 130 withdraws in the second direction the spring 140*a* expands into the bore 111*b* into a resting or neutral configuration as previously described, and can now be shifted, e.g. rotated, in the groove 120 to flip to a second energised canted configuration, driven by the return movement of the piston 130 axially within the bore 111*b* in the first direction from right to left in the drawings. As the nose sweeps past the open inner end of the groove housing the first spring 140*a*, the nose pushes the unsupported and protruding outer end of the spring 140*a* into an alternative second energised canted configuration in which the major axis of the spring 140*a* is now aligned with the opposite diagonal in the groove 120 as compared with the original configuration adopted by the other springs 140*b, c, d*.

The shoulder 131 again engages with the outer end of the spring 140*a* protruding from the groove 120, but because the spring 140*a* has shifted orientation from the first to the second configuration, the shoulder 131 compresses the minor axis rather than the major axis, so the piston 130 continues moving until the spring 140*a* passes the shoulder 131.

Movement of the piston 130 out of the bore 110*b* forces the support sleeve 150 against the inner end of the housing sleeve 111, and causes the support sleeve 150 to slide axially with respect to the piston 130 until the support sleeve 150 uncovers the next recess holding spring 140*b*. The spring 140*b* experiences the same "bump" when transitioning the step in OD between the support sleeve 150 and the nose, but remains in the same first compressed canted configuration as previously described.

Figure 18:
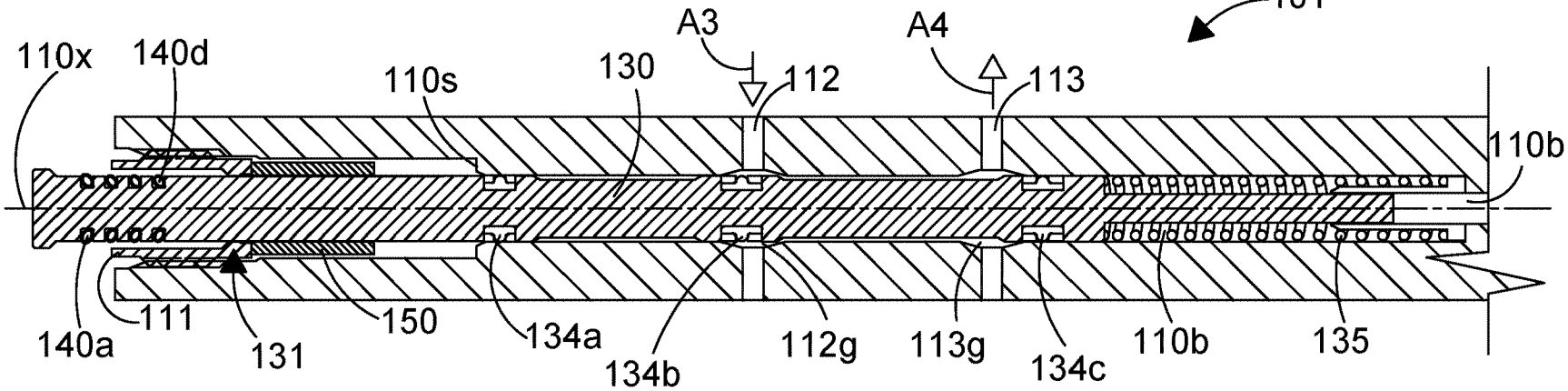
Figure 19:
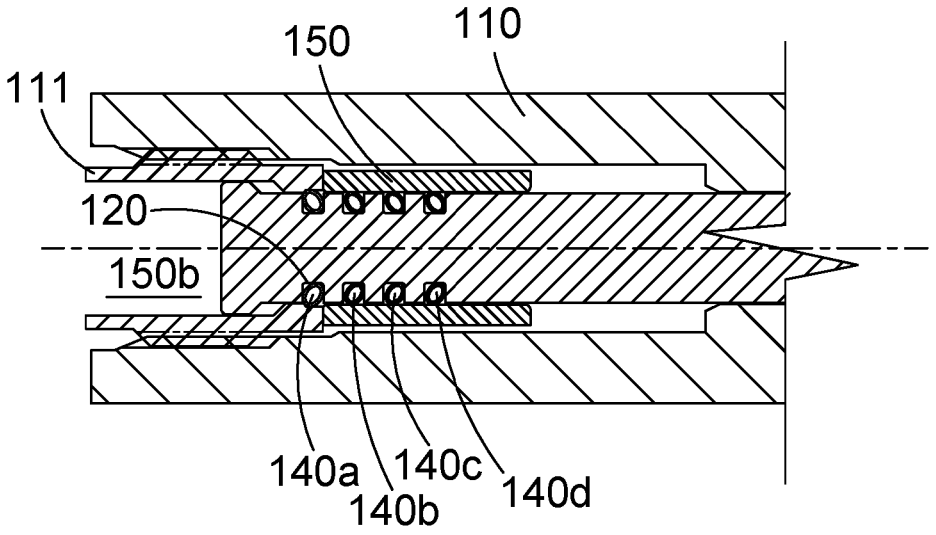
FIGS. 19-22 show enlarged views of the interaction of the shoulder and springs in the second example.

Thus it can be seen that moving the piston 130 across the free end of a groove 120 first in one direction and then in the opposite direction can shift the spring 140 within the groove from one compressed canted position to a neutral position, and then to an opposite compressed canted position. Shifting the spring 140 between different canted configurations, from a first configuration in which the spring 140 engages with the piston 130 and resists passage of the piston 130 past the groove 120, to a second configuration in which the spring 140 engages with the piston 130 and permits passage of the piston 130 past the groove 120 holding the spring 140 is used in this example to stop the movement of the piston 130 in defined positions in the bore as previously described, until the final position is reached as shown in FIG. 18. In the final cycle before the FIG. 18 position, when the fluid pressure is reduced, the spring force pushes the piston 130 axially through the bore 110 *b* past all of the springs 140 *a, b, c* and *d*, which are all in the neutral position and offer little or no resistance to the passage of the piston 130. Thus the piston 130 moves under the force of the compressed spring 135 until the seal 134 *b* is unloaded, and the valve is open allowing fluid to flow into the inlet 112 and then exit from the outlet 113, as shown by arrows A3 and A4, respectively.

The valve 101 can be reset by moving the piston 130 axially back into the bore in a reset stroke. At that stage, the pressure can be released, and the piston 130 will return under the force of the spring 135 to the FIG. 15 position, where it is restrained by the first compressed canted configuration of the spring 140*a*. Optionally the axial position of the support sleeve 150 within the bore 110*b* can be adjusted after reset operations by a separate control line providing fluid pressure to the support sleeve 150 to move it back into the FIG. 15 position after resetting.

Referring now to FIGS. 23-30, a third example of an actuator assembly in the form of a valve 201 has features similar to the valve 1, which are referenced with the same number but increased by 200. The skilled person is directed to the first and second examples described herein for a full description of similar parts. In the valve 201, instead of the piston being contained within a bore in a fixed housing, the piston is in the form of a sleeve with a bore which accommodates a fixed mandrel, on which the piston sleeve slides axially. The piston sleeve and mandrel are contained in a housing (not shown) which may incorporate seals on the outer surface of the piston. The valve 201 thus has a fixed member in the form of a fixed mandrel 210, in the form of a generally cylindrical rod fixed in position on the assembly and having an axis, and having an inner end (shown in the drawings on the right hand side) fixed to a body. The mandrel 201 has an outer end (shown in the drawings on the left hand side) where the mandrel 201 terminates and allows the assembly of the different sleeves and springs onto the mandrel 201. The mandrel 201 is received within the bore of an actuating member in this example taking the form of a piston sleeve 230. The annulus between the bore of the piston sleeve 230 and the mandrel 201 is sealed in the same manner as previously described, with seals 234*a-c* and an additional seal 234*d* in an outer section of the bore of the piston sleeve 230 having a wider inner diameter than an inner section. The axial inward travel of the piston sleeve 230 is limited by an end shoulder on a cylindrical boss disposed on the outer end of the mandrel 210, disposed in the wide diameter outer section of the piston sleeve 230. The outward axial travel of the piston sleeve 230 over the mandrel 210 is limited by opposing chamfered edges on the outer end of the boss on the mandrel 210 and the inner end of the wider section in the bore of the piston sleeve 230. The piston sleeve 230 incorporates a fluid inlet and outlet 212, 213, which cooperate with the seals 234 *a-c* in the same manner as described for seals 34*a-c* and outlet and inlet 12 and 13. A spring 235 is held in compression between an inner end of the piston sleeve 230 and an outwardly facing shoulder on the mandrel 210.

In the third example 201, the shoulder 231 is located on the actuating member of the piston sleeve 230 and the recesses and springs are located on the fixed member of the mandrel 210. Thus, the outer surface of the mandrel 210 has a plurality of recesses in the form of circumferential annular grooves 220 having a similar geometry to the grooves 20, containing canted coil springs 240 essentially as described for the first example.

The support sleeve 250 has a co-axial bore which accommodates the mandrel 210 and allows the support sleeve 250 to move axially in each direction with respect to the mandrel 210 and the grooves 220, and with respect to the piston sleeve 230. The support sleeve 150 is disposed in tandem with the piston sleeve 230 in much the same manner as described in the first example, so that the piston sleeve 230 pushes the support sleeve 250 axially when moving in the first direction (in this case outwardly from right to left). As previously described, the axial position of the support sleeve 250 is optionally maintained by friction between the support sleeve 250 and the springs 240, so that the support sleeve 250 can move relative to the piston sleeve 230 when the friction is overcome, but retains its position on the mandrel 210 in the absence of any forces (e.g. applied by the piston sleeve 230) tending to move it so remains static on the mandrel 210 when the piston sleeve 230 withdraws from it. The shoulder 231 is disposed on the outer end of the piston sleeve 230, facing the support sleeve 250.

Figure 23:
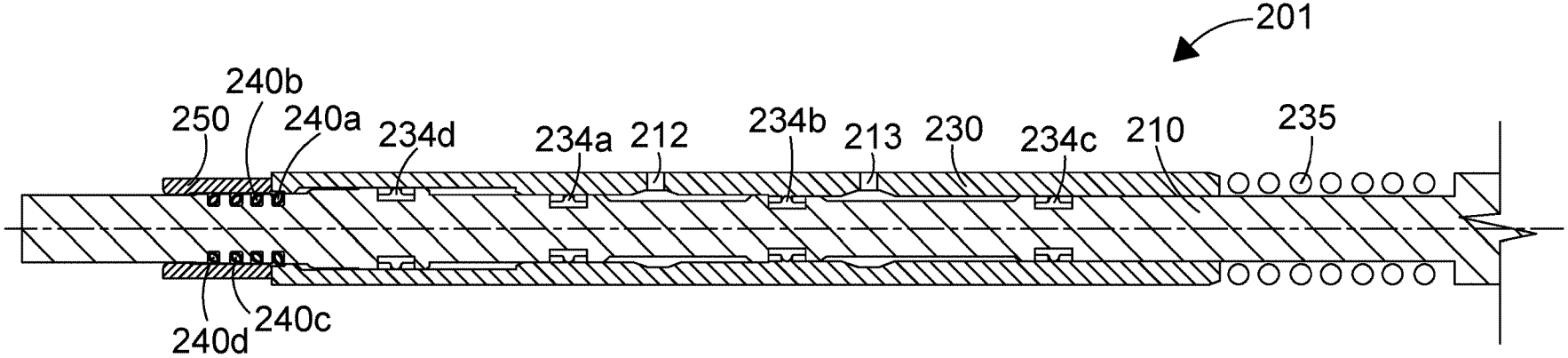
FIGS. 23-26 show a third example of an actuator assembly in sequential positions of actuation.
Figure 24:
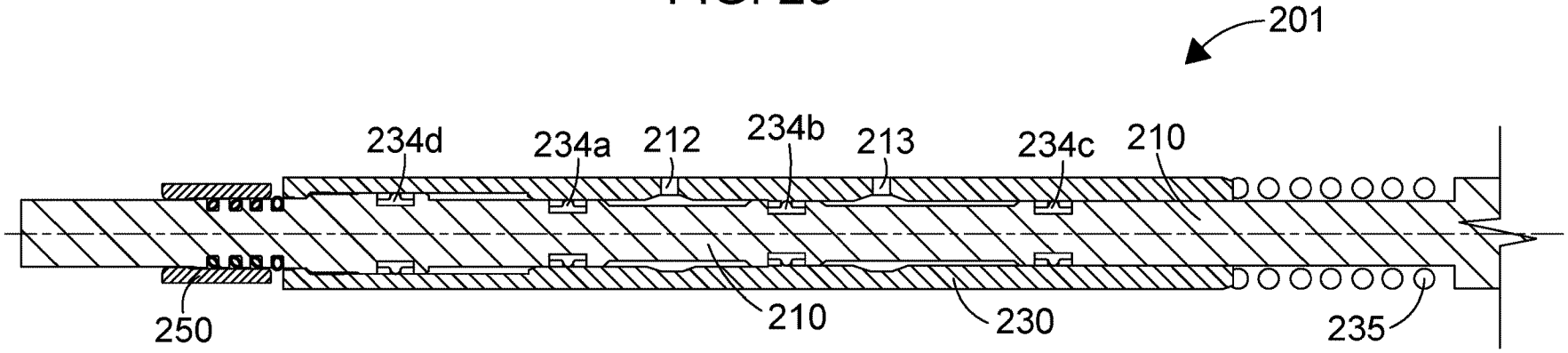
Figure 25:
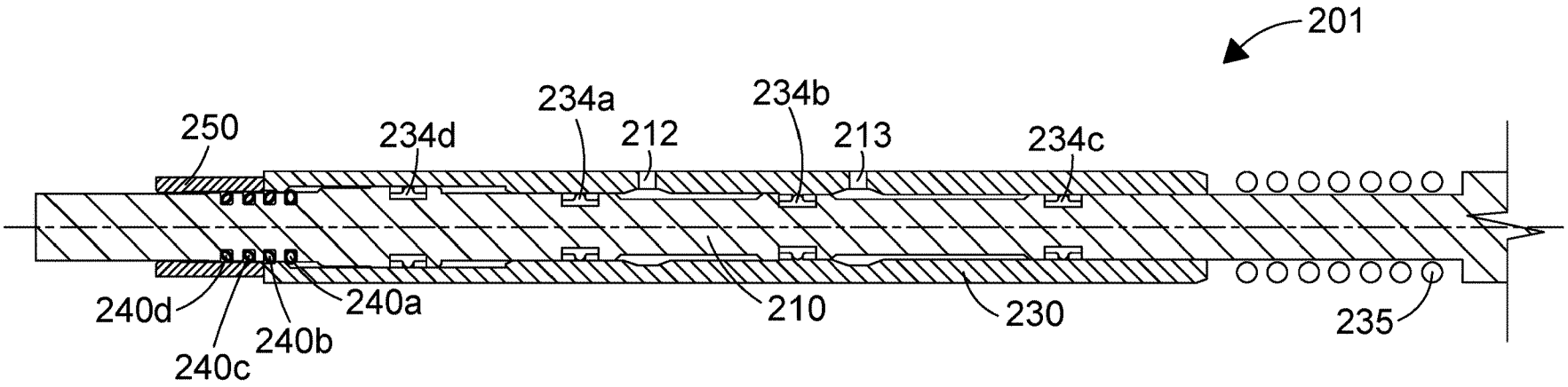

To set up the assembly for actuation, the piston sleeve 230 is compressed into the FIG. 24 configuration, with the piston sleeve 230 retracted towards the inner end of the mandrel 210 and the spring compressed as the piston sleeve 230 moves inwards in the second direction, from left to right in the drawings in a reset stroke. The inner end of the shoulder 231 on the piston sleeve 230 has a ramp similar to the ramp 33 on the first example, which slides across all of the open ends of the grooves 220 housing springs 240*a-d*. This has moved the protruding outer ends of the springs to the right towards the inner end of the mandrel 210, so as they compress within their respective grooves 220, they adopt the first compressed canted configurations shown in FIG. 23 generally aligned with one diagonal, with their outer ends pushing out of the grooves 220 furthest from the outer end of the mandrel 210 and closer to (and pointing towards) the shoulder 231, while the inner ends are trapped in an inner end corner of the groove, closer to the outer end of the mandrel 210 and axially further away from the shoulder 231 than the outer ends of the springs (and facing away from the shoulder 231). This motion is compressing the springs along their minor axes rather than their major axes, so they compress easily into the grooves 220. When moving inwards, the chamfered face on the inner end of the wider diameter section of the piston sleeve 230 is eventually pressed against the chamfered face on the outer end of the cylindrical boss on the mandrel 210, to limit the axial movement. The support sleeve 250 can be urged inwards at this point by fluid pressure or the like during or after resetting to cover all of the springs 240, and maintains the springs 240*a-d* in this first canted configuration. Axial movement of the support sleeve 250 can be driven by fluid pressure through a separate control line as described for previous examples. When all springs 240 have adopted the first compressed and canted configuration shown in FIG. 23 and are covered by the support sleeve 250, the fluid pressure forcing the piston sleeve 230 inwards towards the inner end of the mandrel 210 is reduced, allowing the spring 235 to drive the piston 230 in the first direction, from right to left in the drawings, outwardly over the mandrel 210 to the FIG. 23 position.

In FIG. 23, the innermost (first) groove on the inner end of the mandrel 210 housing spring 240*a* is shown axially aligned with the nose of the inner end of the piston sleeve 230, which supports and compresses the springs within the grooves as previously described.

In the initial configuration ready for actuation, each spring 240 adopts an energised elliptical configuration. The stroke of the piston sleeve 230 and support sleeve 250 has set the springs 240 in the first configuration, with the major axis of each spring 240 having an inner end disposed in the groove 220 facing the outer end of the mandrel 210 and spaced radially closer to the axis of the mandrel than the outer end of the spring protruding from the groove 220 through the open end of the groove 220, facing the inner end of the mandrel and the shoulder 231. The inner end of the spring 240 is further away (in an axial direction) from the shoulder 231 than the outer end of the spring 240. In this first configuration, each spring 240 resists further compression along its major axis as previously described. The spring 240*a* is held in this first configuration, in compression along its major axis by the nose. As the piston sleeve 230 moves in a first direction from right to left, the shoulder 231 engages with the outer end of the major axis of the spring 240*a* that is protruding from the groove 220 and facing towards the shoulder 231, and in this arrangement, the spring 240*a* cannot compress further into the groove 220 along its major axis and resists further movement of the shoulder 231 (and hence the piston sleeve 230) in the first direction (e.g. towards the outer end of the mandrel 210 from right to left in this example). The piston 230 can withdraw in the opposite second direction in the bore but cannot move forward past this point without disrupting (i.e. breaking) the spring 240*a*.

Withdrawal of the piston sleeve 230 back into the bore in the second direction as is shown in the transition from FIG. 23 to FIG. 24 drives the piston sleeve 230 backwards from left to right towards the inner end of the mandrel 210 to uncover the open end of the first groove housing the first spring 240*a*, with seals 234*a, b* and *c* still isolating the inlet and outlet 212, 213, and preventing any fluid flow therethrough. As the piston sleeve 230 retracts in the second direction the spring 240*a* expands out of the groove 220 into a resting or neutral configuration as previously described, and can now be shifted, e.g. rotated, in the groove 220 to flip to a second energised canted configuration, driven by the return movement of the piston sleeve 230 axially towards the outer end of the mandrel 210 in the first direction from right to left in the drawings. As the nose sweeps past the open inner end of the groove housing the first spring 240*a*, the nose pushes the unsupported and protruding outer end of the spring 240*a* into an alternative second energised canted configuration in which the major axis of the spring 240*a* is now aligned with the opposite diagonal in the groove 220 as compared with the original configuration adopted by the other springs 240*b, c, d*.

The shoulder 231 again engages with the outer end of the spring 240*a* protruding from the groove 220, but because the spring 240*a* has shifted orientation from the first to the second configuration, the shoulder 231 compresses the minor axis rather than the major axis, so the piston sleeve 230 continues moving until the spring 240*a* passes the shoulder 231.

Movement of the piston sleeve 230 towards the outer end of the mandrel 210 engages the support sleeve 250 against the outer end of the piston sleeve 230, and causes the support sleeve 250 to slide axially with respect to the mandrel 210 until the support sleeve 250 uncovers the next recess holding spring 240*b*, in the same first compressed canted configuration as previously described.

Figure 26:
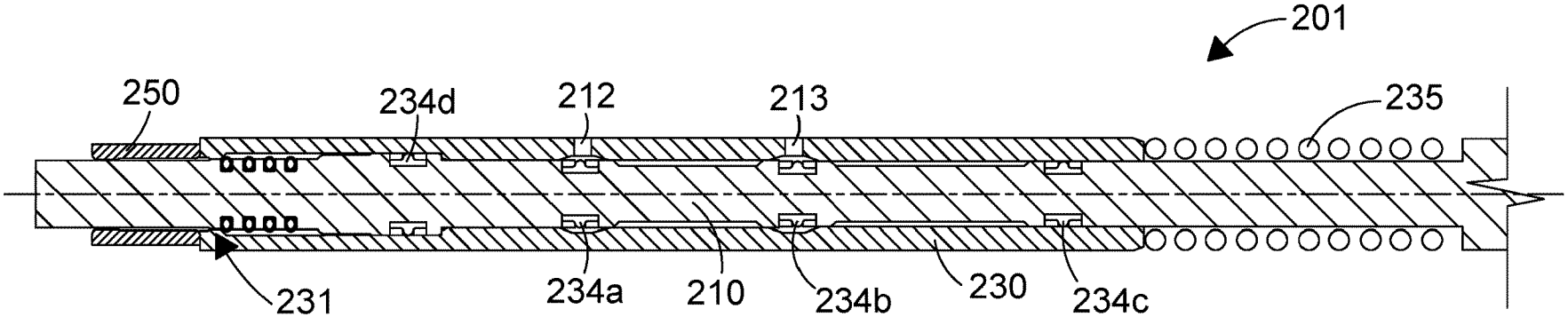
Figure 27:
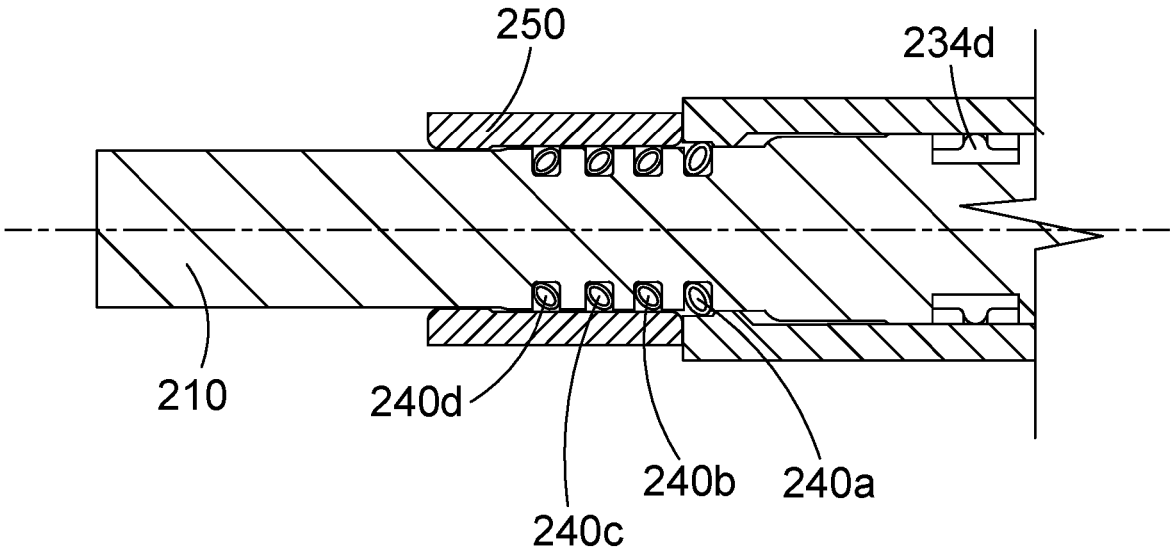
FIGS. 27-30 show enlarged views of the interaction of the shoulder and springs in the third example.
Figure 28:
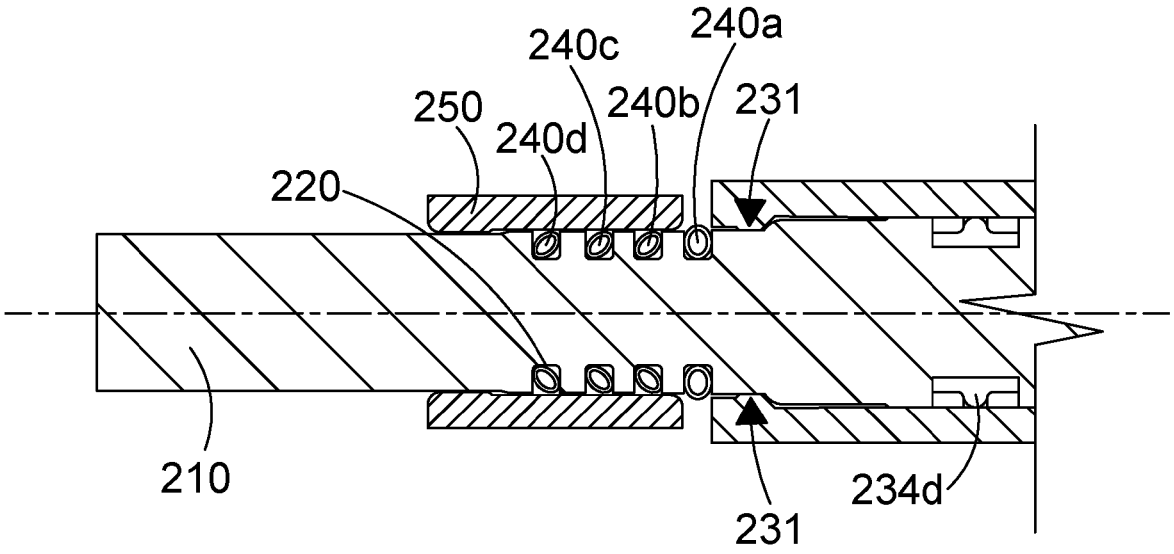
Figure 29:
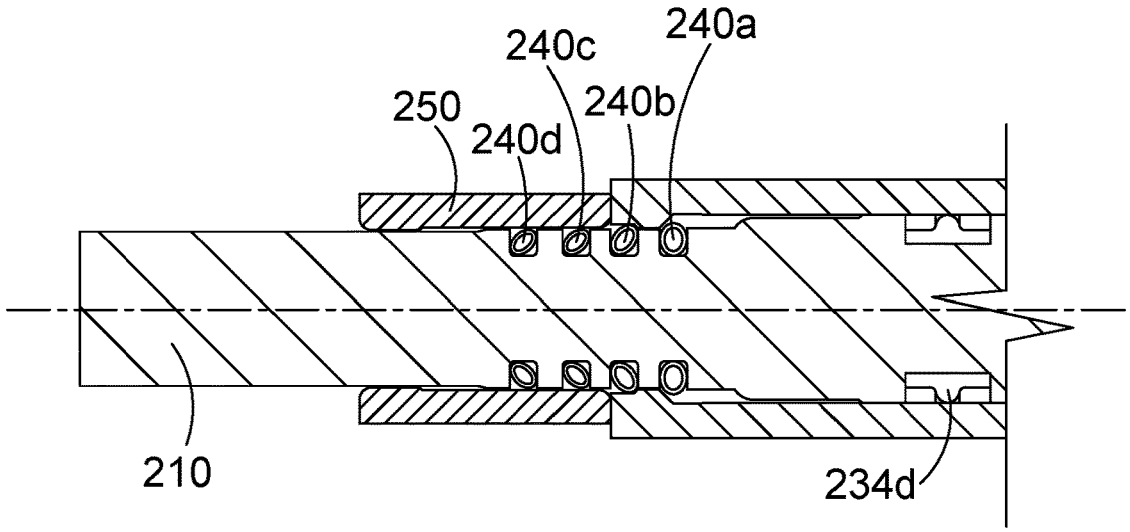
Figure 30:
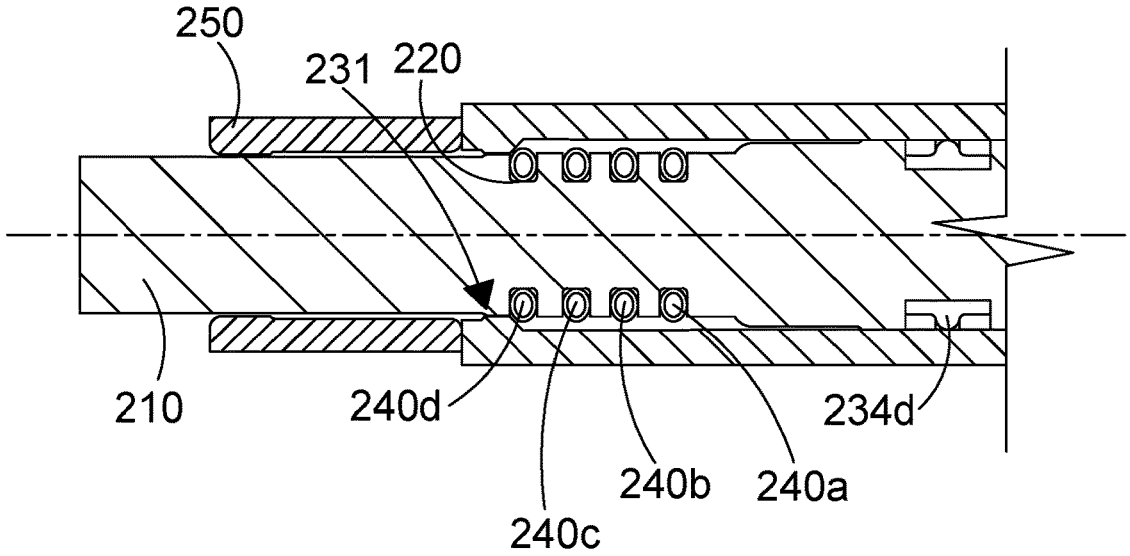

Thus it can be seen that moving the piston sleeve 230 across the free end of a groove 220 first in one direction and then in the opposite direction can shift the spring 240 within the groove from one compressed canted position to a neutral position, and then to an opposite compressed canted position. Shifting the spring 240 between different canted configurations, from a first configuration in which the spring 240 engages with the piston sleeve 230 and resists passage of the piston sleeve 230 past the groove 220, to a second configuration in which the spring 240 engages with the piston sleeve 230 and permits passage of the piston sleeve 230 past the groove 220 holding the spring 240 is used in this example to stop the movement of the piston sleeve 230 in defined positions in the bore as previously described, until the final position is reached as shown in FIG. 26. In the final cycle before the FIG. 26 position, when the fluid pressure is reduced, the spring force pushes the piston sleeve 230 axially past all of the springs 240*a, b, c* and *d*, which are all in the neutral position and offer little or no resistance to the passage of the piston sleeve 230. Thus the piston sleeve 230 moves under the force of the compressed spring 235 until the seal 234*b* is unloaded and the valve is open allowing fluid to flow from the inlet 212 to the outlet 213.

The valve 201 can be reset by moving the piston sleeve 230 axially back towards the inner end of the mandrel 210 in a reset stroke. The support sleeve 250 can be moved with it as previously described. At that stage, the pressure can be released, and the piston sleeve 230 will return under the force of the spring 235 to the FIG. 23 position, where it is restrained by the first compressed canted configuration of the spring 240*a*.

In the third example, the recesses and springs are provided on the fixed member, and the shoulder is provided on the actuating member, but just as described for the second example, this arrangement could be reversed.

Referring now to FIGS. 31-46, a fourth example of an actuator assembly in the form of a valve 301 has features similar to the valve 1, which are referenced with the same number but increased by 300. The skilled person is directed to the first example described herein for a full description of similar parts; also features of the present example can be applied to the first example. The valve 301 has a fixed member in the form of a tubular housing 310 having box and pin connections at opposite ends to connect in line with a tubing string, with a tubular bore 310*b* which receives an actuating member in this example taking the form of a piston 330 which is centralised and sealed in the bore 310*b* of the housing 310 as previously described. As in the first example, the shoulder 331 is located on the actuating member of the piston and the recesses and springs are located on the fixed member of the housing 310, but as previously described these could be reversed.

In the fourth example, the inward travel of the piston 330 is limited by a ramp on the inner end of the head of the piston and an outwardly-facing shoulder on the housing 310. The housing 310 has a cap 310*c*, which is connected to the housing by a screw thread. The cap 310*c* retains within the bore 310*b* a housing sleeve 311, itself having a central bore which is coaxial with the bore 310*b* of the housing 310, in which the piston 330 slides axially. The housing sleeve 311 has grooves and springs 340*a, b* and *c* as described for the housing sleeve 11.

One difference between the first and fourth examples is the provision in this fourth example of a tubular bore through the piston 330, coaxial with the bore of the housing 310, and allowing a flowpath through the valve so that it can be connected in line with a conduit such as a tubing string. This permits the valve 301 to be used as a circulation valve. For this purpose, the inner end of the piston 330 has radial channels 330*a, b*, and *c* set in the walls of the piston 330 and spaced axially along it; the piston 330 slides in the bore 310*b* of the housing to move the radial channels 330*a, b, c* sequentially in and out of alignment with an outlet port 313 in the side of the housing 310. The piston 330 is sealed into the bore 310*b* by seals 334*a, b* which control the flow of fluid through the outlet port 313 in a similar way as is described for the seals 34. The piston 330 is moved axially in the housing 310 by spring 335 in a similar way as is described for the first example.

Figure 32:
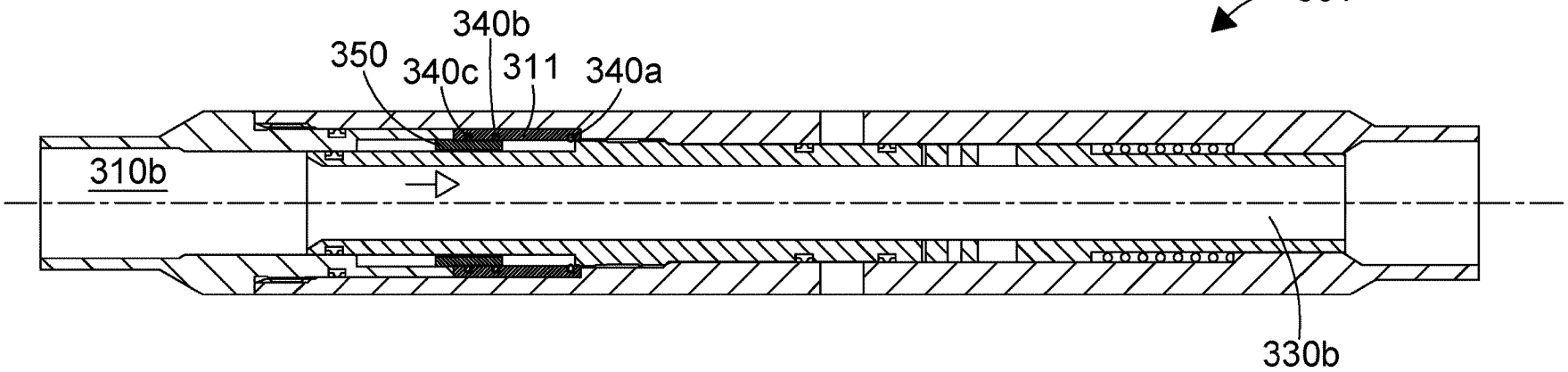
Figure 45:
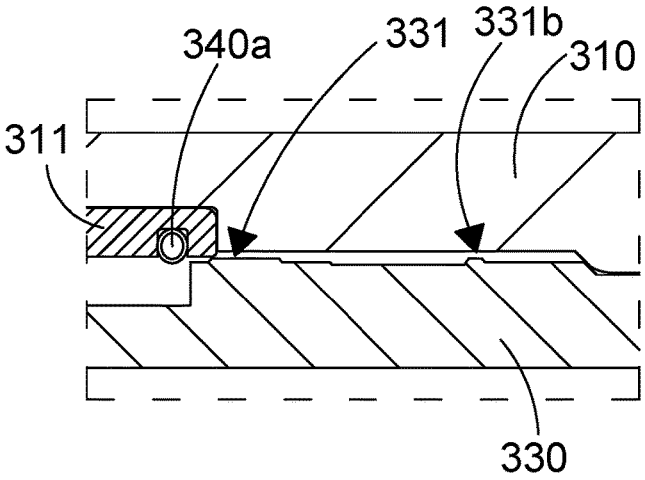

A further difference between the fourth and the first examples relates to the shoulder 331, which is most clearly shown in the expanded view of FIG. 45, which is an enlarged view of the FIG. 32 position of the valve 301.

As best shown in FIG. 45, the outer end of the piston 330 has a head having a larger outer diameter than the central section of the piston 330 with a plateau section, a nose and an inwardly-facing ramp as previously described. The head has a shoulder 331 facing the outer end, and a shoulder 331*b* facing the inner end of the bore 310*b*. Between the shoulders 331, 331*b* the plateau section has a stepped profile where the outer diameter of the plateau steps radially inwards as best shown in FIG. 45.

Figure 31:
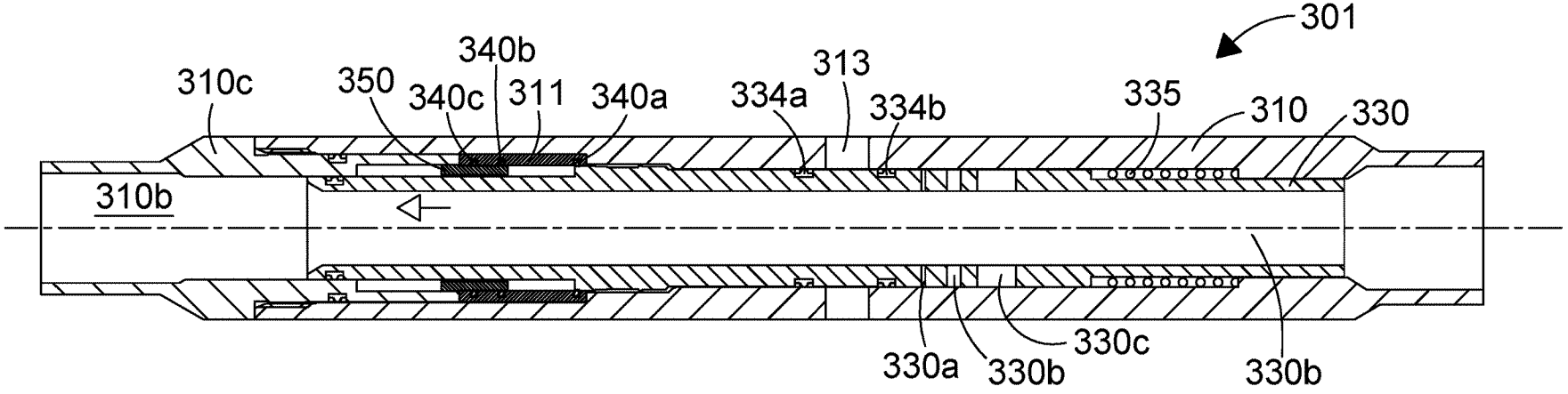
FIGS. 31-37 show a fourth example of an actuator assembly in sequential positions of actuation.

In the initial FIG. 31 position, the piston 330 is urged by the spring 335 against the first spring 340*a* which is engaging the shoulder 331 in a similar way as is described previously, with each spring 340 energised in the first canted compressed configuration. The piston 330 therefore cannot move any further in the first direction, out of the bore, in the direction of the arrow in FIG. 31. Increasing pressure to drive the piston 330 back into the bore in the second direction from left to right into the bore 310*b* uncovers the open end of the first groove housing the first spring 340*a*, and drives the ramp at the inner end of the head against an outwardly facing shoulder on the bore 310*b* which limits the axial travel in the second direction (in the direction of the arrow shown in FIG. 32). In this position, the seals 334*a, b* still isolate the outlet 313, and prevent any fluid flow therethrough. As the piston 330 withdraws into the bore 310*b* in the second direction and the support sleeve 350 remains static, the open end of the groove housing spring 340*a* is uncovered so the spring 340*a* is unsupported on its inner diameter and therefore expands into the bore of the housing sleeve into a resting or neutral configuration. When the fluid pressure acting on the piston 330 to keep it in the FIG. 32 position is reduced so that the force from the fluid pressure is below the force of the spring 335, the piston 330 is urged out of the bore by the spring, moving once more in a first direction from right to left in the drawings (see the arrow in FIG. 33), pushing the unsupported and protruding outer end of the spring 340*a* in the first direction, into the alternative second energised canted configuration, which is retained by the stepped shape of the region of the head between the shoulders 331 and 331*b* as the piston 330 moves in the first direction, pressing the spring 340*a* further into the groove, and permitting passage of the shoulder 331 in the first direction past the compressed spring 340*a* in the second canted compressed configuration. The piston head also re-engages the inner end of the static support sleeve 350, pushing it further outwards in the bore in a manner essentially similar to the transition between FIGS. 2-5, except that instead of the first spring 340*a* reverting to its resting or neutral configuration once the shoulder passes, it is maintained in the second configuration by the stepped profile of the plateau of the piston 330, and of course the previously-described structural differences of the bore 330*b* and the outlet channels 330*a, b, c* in the piston 330.

Figure 33:
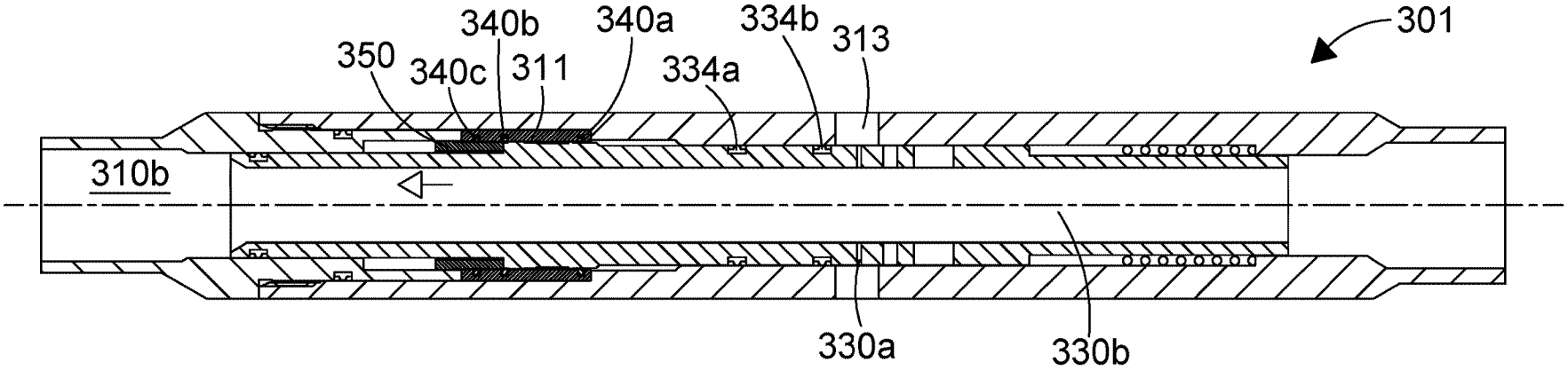

In the FIG. 33 position, the piston 330 is checked against continued axial movement in the first direction (of the arrow in FIG. 33) by the spring 340*b*, engaged against the outer face of the shoulder 331 in the first configuration. In this position, the seals 334*a, b* no longer isolate the outlet port 313 and the narrowest channel 330*a* is aligned with it, permitting flow from the bore 330*b* out of the valve 301 but choking it to its lowest flow rate.

Figure 34:
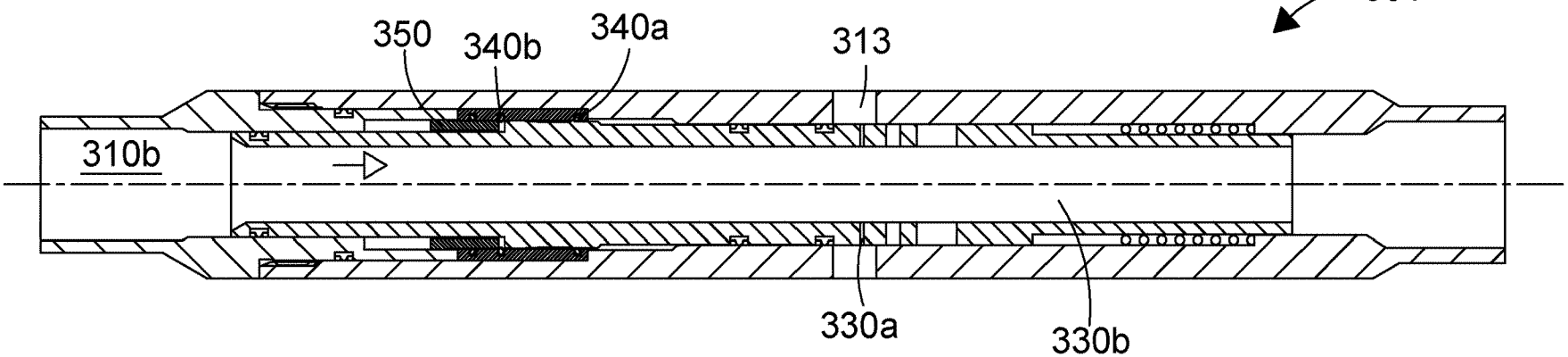
Figure 35:
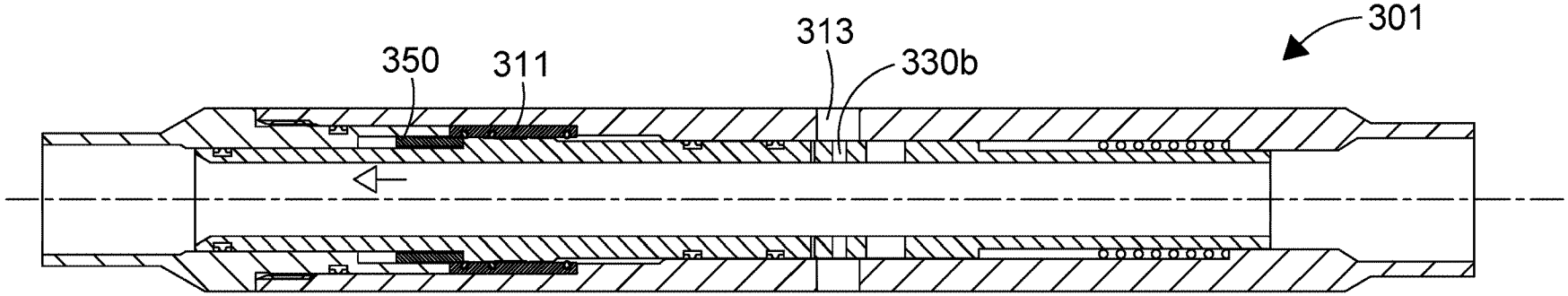

Whereas in the transitions between the configurations shown in FIG. 5-7 require the piston 30 in the first example to move axially all the way back to the initial position shown in FIG. 6, the fourth example is different in that the first spring 340*a* remaining in the second configuration acts as a stop in the opposite direction to resist axial movement of the piston 330 in the second direction past the position shown in FIG. 34, in which the spring 340*a* is engaged with the shoulder 331*b*, without requiring further movement of the piston 330 all the way back to the FIG. 32 position. Hence, reduction of the fluid pressure acting on the piston 330 after the FIG. 34 position causes the spring 335 to move the piston 330 once more in the first direction (see the arrow in FIG. 35) so that the shoulder 331 engages with the third spring 340*c* and stops, with the second channel 330*b* aligned with the outlet port 313, choking the flow therethrough to a slightly higher flow rate than the narrowest channel 330*a*.

Figure 36:
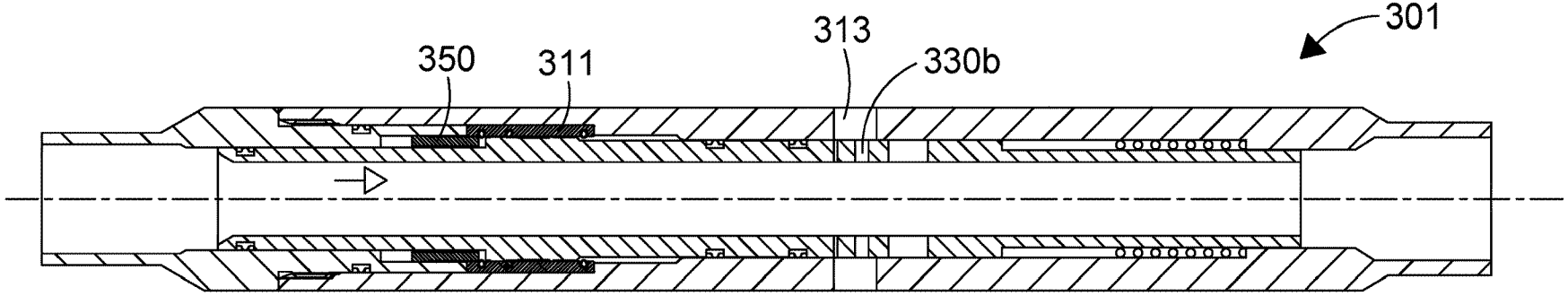
Figure 37:
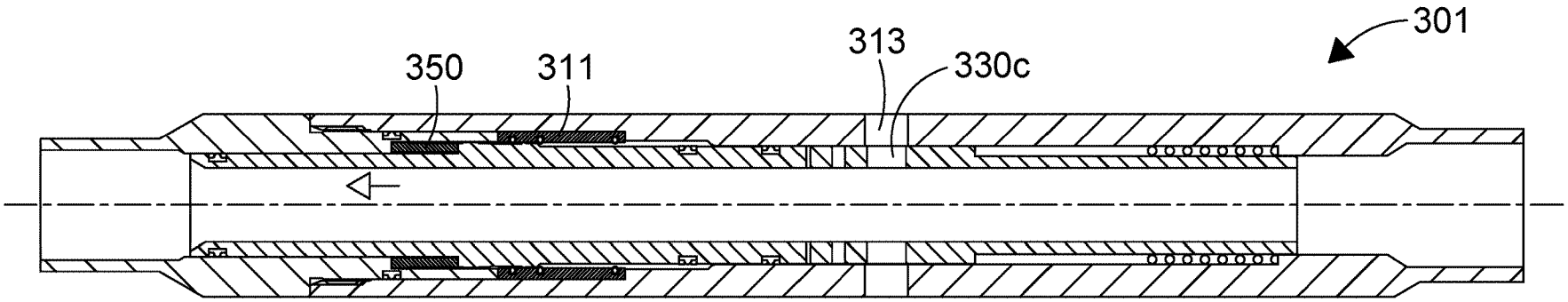
Figure 46:
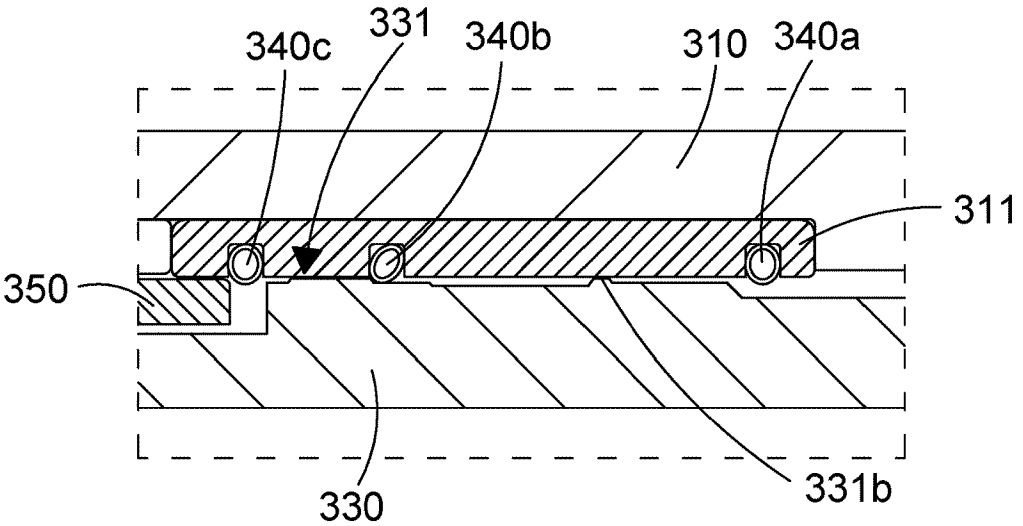
FIGS. 45 and 46 show enlarged views of the interaction of the shoulder and springs in FIGS. 32 and 36 respectively.
Figure 38:
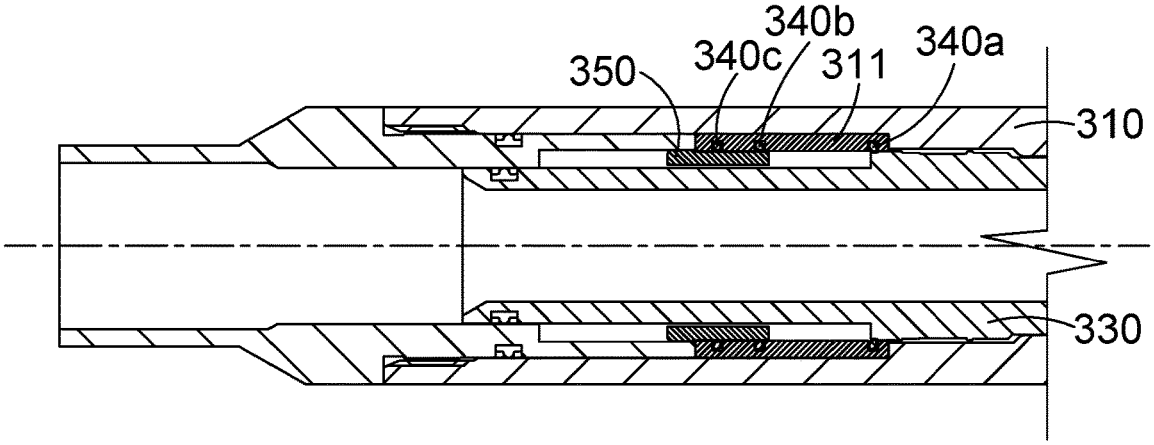
FIGS. 38-44 show enlarged views of FIGS. 31-37.
Figure 39:
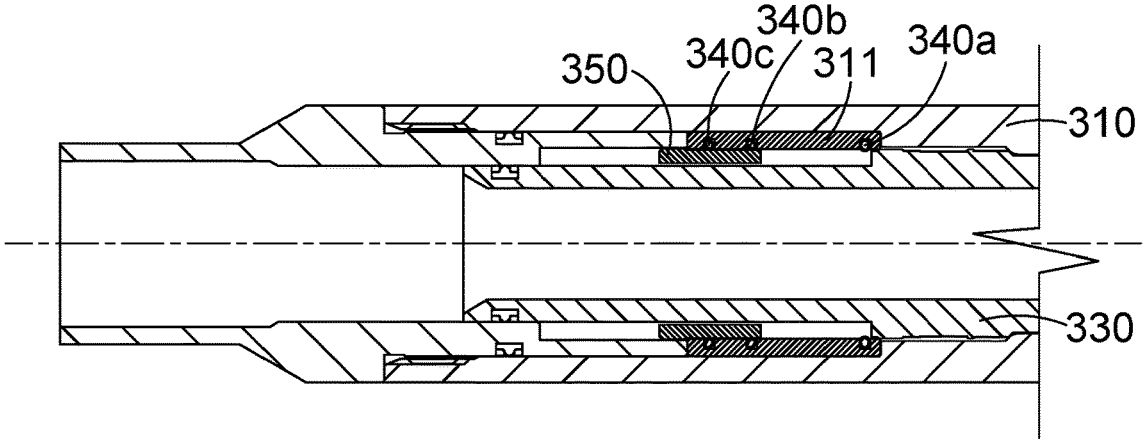
Figure 40:
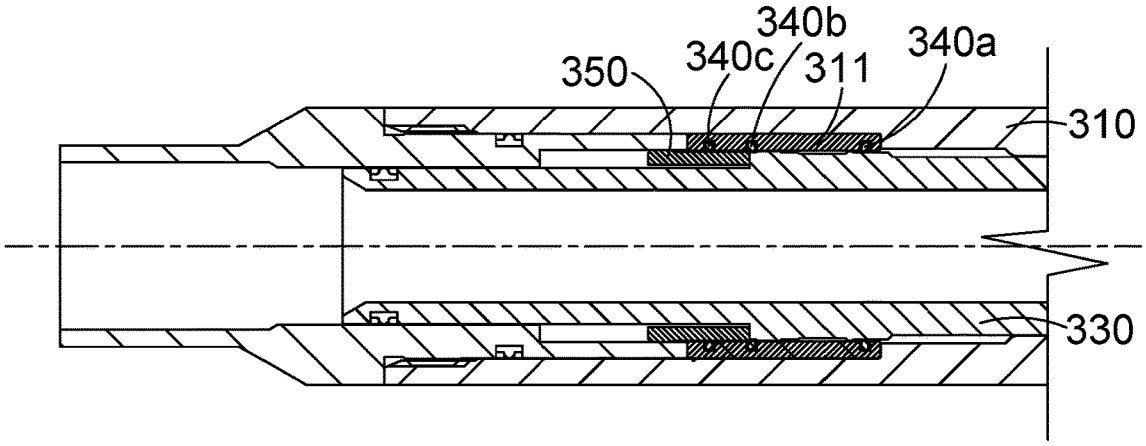
Figure 41:
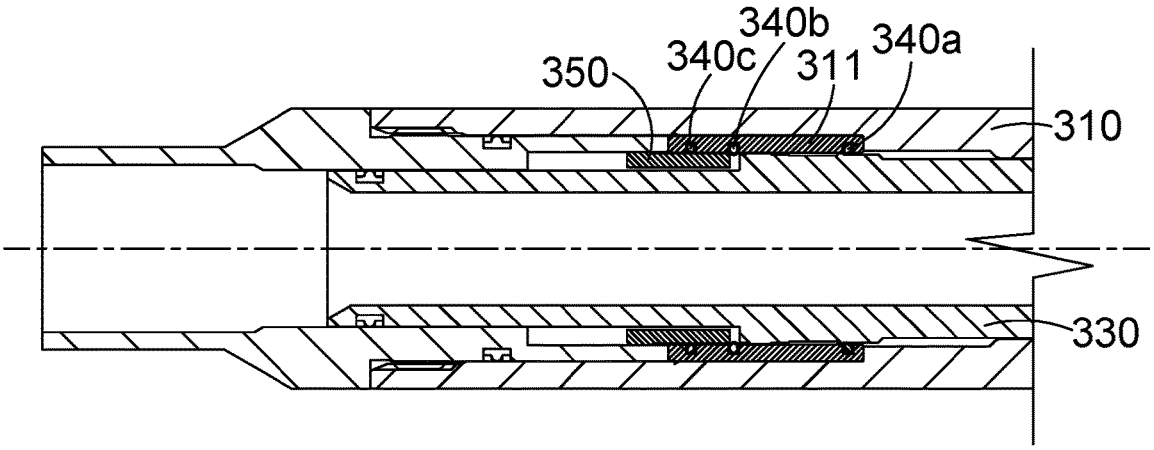
Figure 42:
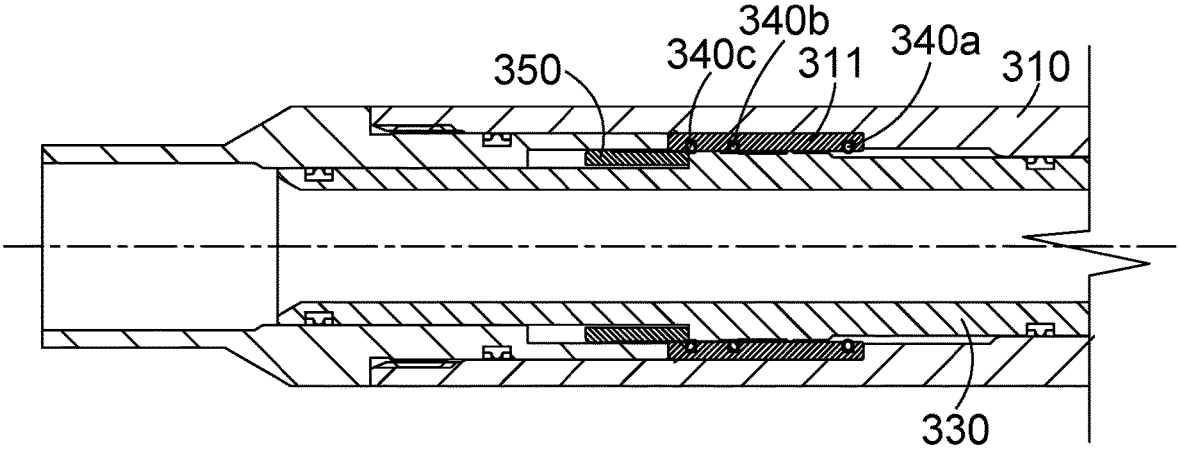
Figure 43:
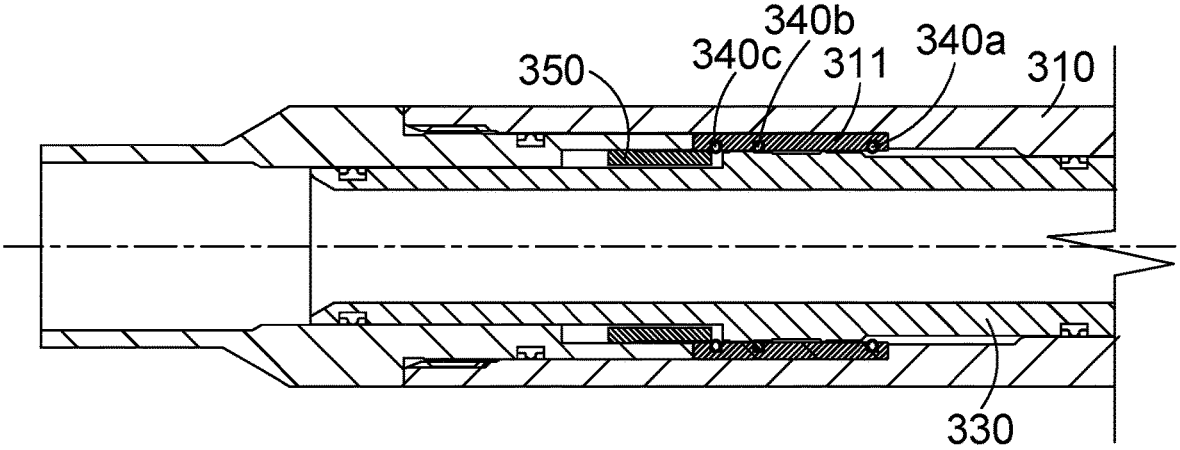
Figure 44:
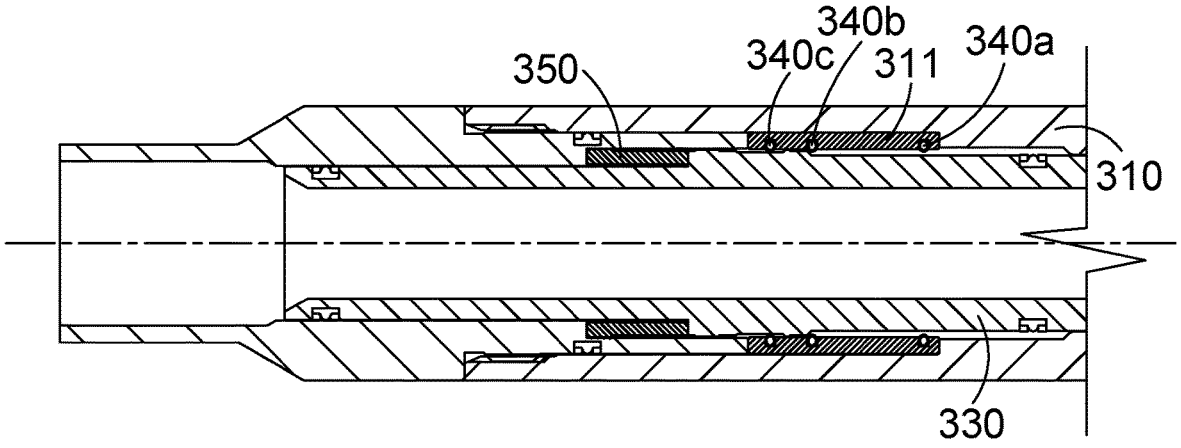

A further fluid pressure increase again drives the piston 330 in the second direction back into the bore 310*b* to reach the position shown in FIG. 36, which uncovers the open end of the groove housing the last spring 340*c* (as best seen in FIG. 46, which is a close up view of the piston 330 in FIG. 36), which adopts the neutral position, while the spring 340*b* is maintained in the second configuration by the stepped profile. Note that as it is no longer needed, the first spring 340*a* is unsupported by the head in the FIG. 36 position, and is in the neutral position also. Note also that the spring 340*b* in the second configuration engages with the inner face of the shoulder 331, also at the same angle as the outer face which engaged with the springs 340 when the piston is moving in the first direction, hence, stopping the reset movement of the piston 330 in the second direction at the FIG. 36 position. From this position, fluid pressure is then reduced again allowing the spring force to return the piston 30 in the first direction as shown in FIG. 37. In reaching this final position, the piston 330 sweeps past the third spring 340*c* in its neutral position, until the outer end of the support sleeve 350 abuts an inwardly facing shoulder on the housing, at which point, continued outward movement of the piston 330 in the first direction is arrested, and the final full bore channel 330*c* is aligned with the outlet port 313 allowing maximum flow of the fluid through the string, through the bore 310*b* of the housing and the bore 330*b* of the piston 330.

The valve 301 can be reset by moving the support sleeve 350 (which pushes the piston ahead of it) axially back into the bore in the second direction (shown by the arrow in FIG. 32) in a reset stroke until the inner end of one or other of the shoulders 331, 331*b* has swept past the grooves housing the springs and all springs 340 have been reset into their first compressed canted configurations shown in FIG. 31. Optionally the support sleeve can be moved by a piston (which can be integral to the support sleeve or can be a separate item, and which can optionally incorporate differential sealed areas) which can be activated by a separate control line providing fluid pressure to move the support sleeve axially in the bore 310*b*. Once the springs 340 have been reset past the FIG. 31 positions, the pressure can be released, and the piston 330 will return the assembly under the force of the spring 335 to the FIG. 31 position, where it is restrained by the first compressed canted configuration of the spring 340*a*.

Referring now to FIGS. 47-52, a fifth example of an actuator assembly in the form of a valve 401 has features similar to the valve 1, which are referenced with the same number but increased by 400. The skilled person is directed to the first example described herein for a full description of similar parts; also features of the present example can be applied to the first example. The valve 401 is essentially the same as the valve 1, with an entirely identical inner end (not shown in FIGS. 47-50 for brevity but shown in FIG. 51) with the differences between the valves 1 and 401 residing in the head and shoulder of the piston. The earlier description of the first example is referred to for a complete description. The shoulder of the fifth example is similar to the shoulder 331 of the fourth example 301, but has a single shoulder having outer and inner faces with a steep angle on each face able to engage a spring and check movement of the piston in different directions. In this example, the shoulder is symmetrical.

The outer end of the piston 430 (best seen in FIG. 52) has a head having a larger outer diameter than the central section of the piston 430 with a plateau section, a nose and an inwardly-facing ramp as previously described. The head has a shoulder symmetrical shoulder 431 having an outer face facing the outer end of the bore 410*b*, and inner face facing the inner end of the bore 410*b*.

Figure 47:
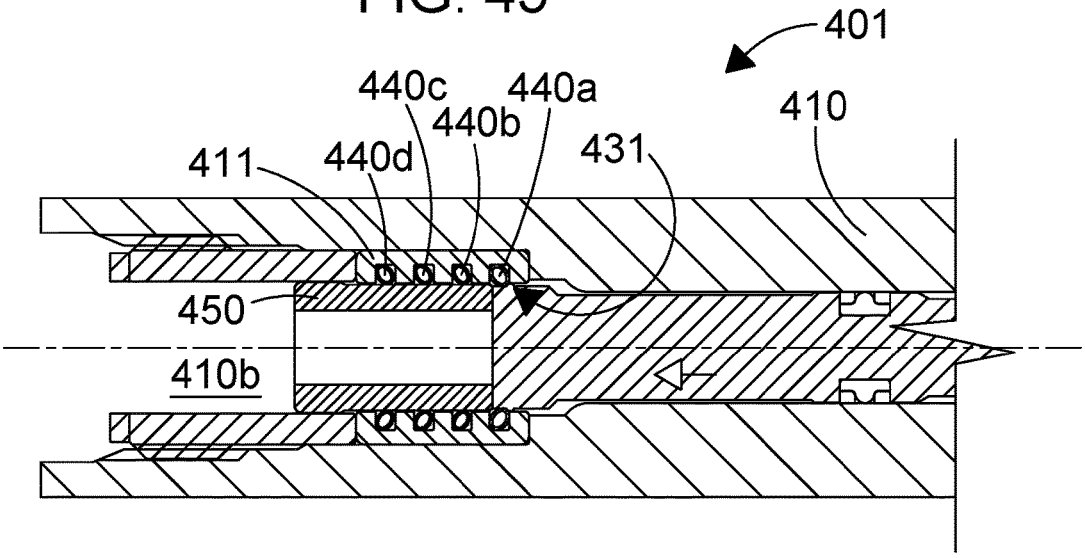
FIGS. 47-50 show enlarged views of a fifth example of an actuator assembly in sequential positions of actuation.

In the initial FIG. 47 position, the piston 430 is urged by the spring against the first spring 440*a* which is engaging the shoulder 431 in a similar way as is described previously, with each spring 440 energised in the first canted compressed configuration. The piston 430 therefore cannot move any further in the first direction, out of the bore, in the direction of the arrow in FIG. 47. Increasing pressure to drive the piston 430 back into the bore in the second direction from left to right into the bore 410*b* uncovers the open end of the first groove housing the first spring 440*a*, and drives the ramp at the inner end of the head against an outwardly facing shoulder on the bore 410*b* which limits the axial travel in the second direction. In this position, the seals still isolate the inlet and outlet. As the piston 430 withdraws into the bore 410*b* in the second direction and the support sleeve 450 remains static, the open end of the groove housing spring 440*a* is uncovered so the spring 440*a* is unsupported on its inner diameter and therefore expands into the bore of the housing sleeve into a resting or neutral configuration. When the fluid pressure is reduced, the piston 430 is urged out of the bore by the spring, moving once more in a first direction from right to left in the drawings (see the arrow in FIG. 48), pushing the unsupported and protruding outer end of the spring 440*a* in the first direction, into the alternative second energised canted configuration, which is retained by the plateau of the head as the piston 430 moves in the first direction, pressing the spring 440*a* further into the groove, and permitting passage of the shoulder 431 in the first direction past the compressed spring 440*a* in the second canted compressed configuration. The piston head also re-engages the inner end of the static support sleeve 450, pushing it further outwards in the bore in a manner essentially similar to the transitions previously described in the fourth example, such that the first spring 440*a* is maintained in the second configuration by the plateau of the piston 430.

Figure 48:
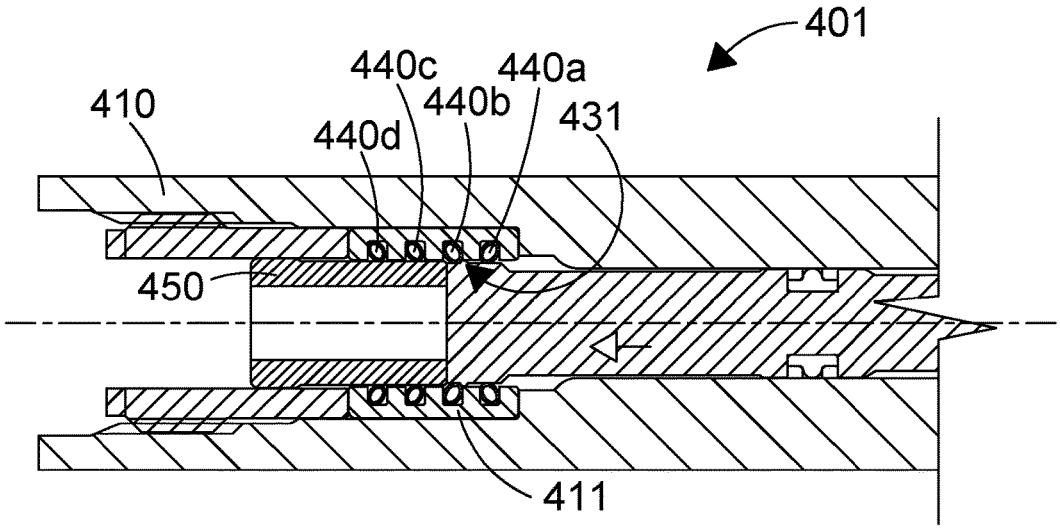
Figure 49:
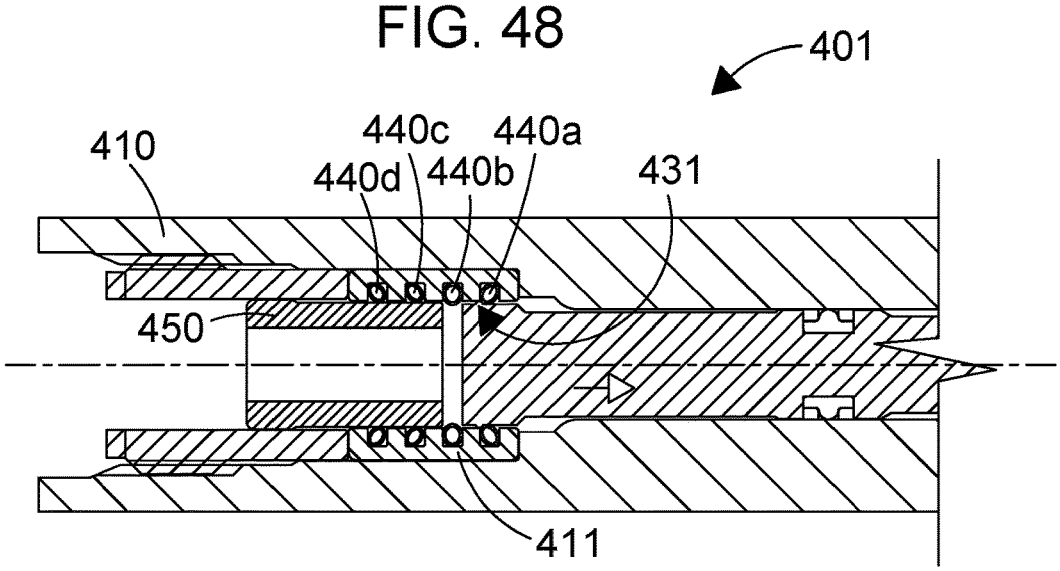
Figure 50:
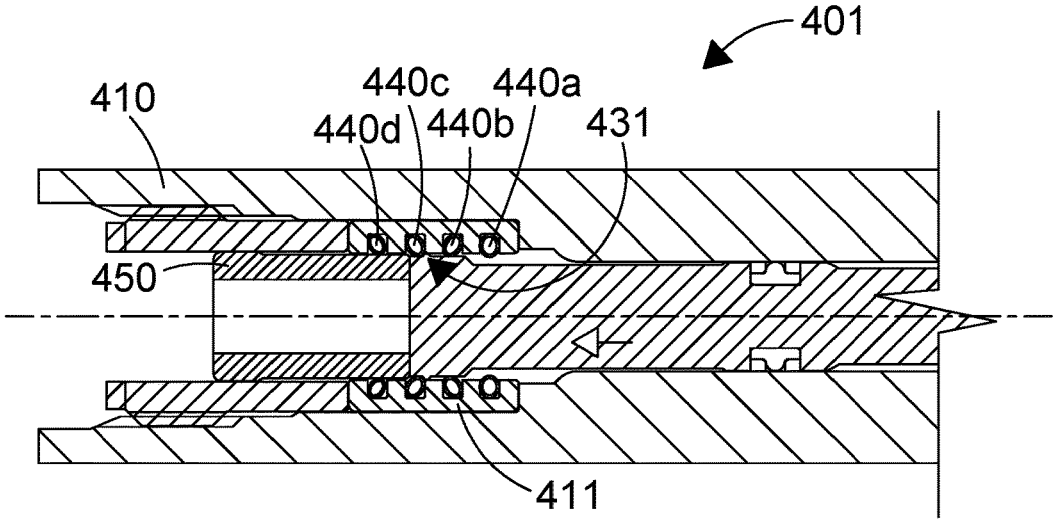
Figure 51:
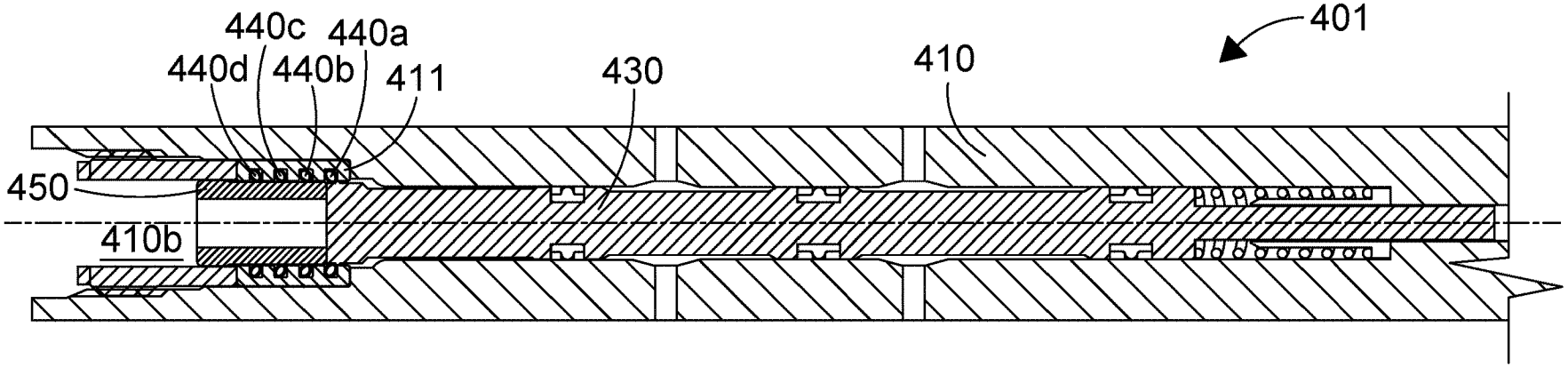
FIG. 51 shows the fifth example of FIGS. 47-50.
Figure 52:
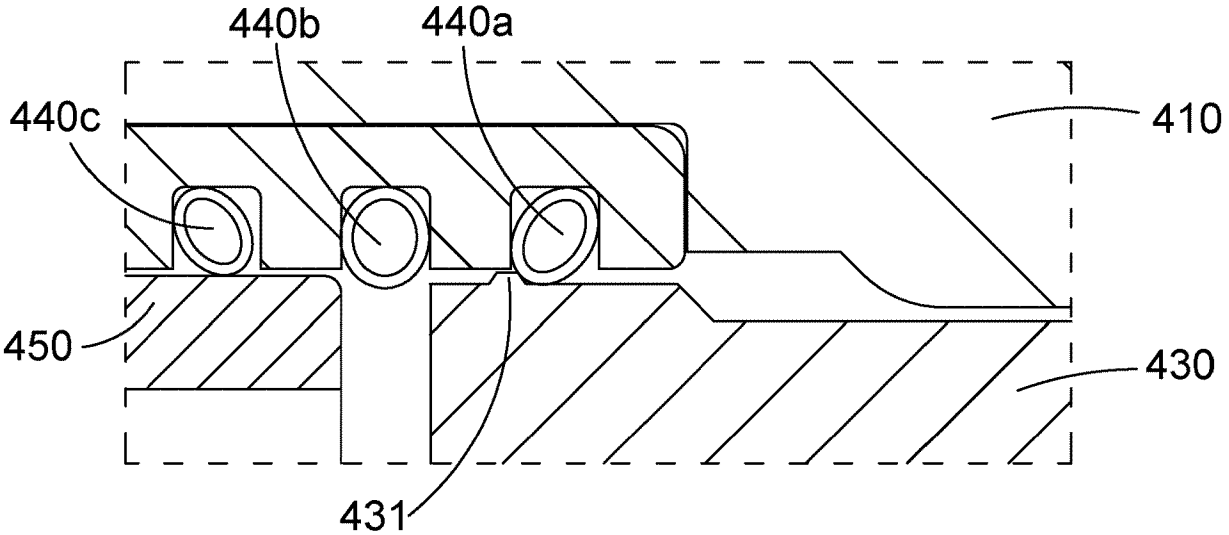
FIG. 52 shows a close up view of the interaction of the shoulder and springs in FIG. 49.

In the FIG. 48 position, the piston 430 is checked against continued axial movement in the first direction (of the arrow in FIG. 48) by the spring 440*b*, engaged against the outer face of the shoulder 431 in the first configuration. Like the fourth example, the transitions of the piston 430 in alternating directions does not require the movement of the piston 430 all the way back into the bore 410*b*. The first spring 440*a* remaining in the second configuration acts as a stop in the opposite direction to resist axial movement of the piston 430 in the second direction past the position shown in FIG. 49, in which the spring 440*a* is engaged with the inner face of the shoulder 431, without requiring further movement of the piston 430 all the way back into the bore. Hence, reduction of the fluid pressure acting on the piston 430 after the FIG. 49 position causes the spring to move the piston 430 once more in the first direction (see the arrow in FIG. 50) so that the shoulder 431 engages with the third spring 440*c* and stops.

A further fluid pressure increase again drives the piston 430 in the second direction back into the bore 410*b* to uncover the open end of the groove housing the third spring 440*c*, which adopts the neutral position, while the spring 440*b* is maintained in the second configuration by the profiled region of the plateau. Note that the first spring 440*a* is unsupported by the head in the FIG. 50 position, and is in the neutral position also. Note also that the spring 440*b* in the second configuration engages with the inner face of the shoulder 431, in this example also at the same angle as the outer face which engaged with the springs 440 when the piston is moving in the first direction, hence, stopping the reset movement of the piston 430 in the second direction. This alternating movement of the piston 430 continues with the piston only withdrawing one step during the reset pressurisation, until the inner end of the piston has moved axially a sufficient distance to change the flowpaths at the inner end of the piston 430.

The valve 401 can be reset by moving the support sleeve 450 as previously described for other examples.

The invention claimed is:

1. An actuator assembly for an oil, gas or water well, comprising:

a fixed member having an axis;

an actuating member being moveable axially with respect to the fixed member;

a plurality of open-ended recesses on one of the fixed member and the actuating member, wherein each recess at least partially houses a respective canted coil spring;

a radially extending shoulder on the other of the actuating member and the fixed member adapted to engage at least a part of at least one of the canted coil springs extending from an open end of a respective one of the plurality of recesses; and a support member adapted to cover open ends of the recesses and being moveable axially into different axial positions with respect to the recesses to uncover open ends of different recesses of the plurality of recesses in the different axial positions of the support member.

2. The actuator assembly as claimed in claim 1, wherein the actuating member is movable relative to the support member.

3. The actuator assembly as claimed in claim 2, wherein the support member is adapted to remain in position relative to at least one of the canted coil springs when the actuating member moves away from the support member.

4. The actuator assembly as claimed in claim 1, wherein the support member is adapted to maintain a minimum level of compression of at least one of the canted coil springs within a respective one of the plurality of recesses when the support member covers the open end of the recess, and wherein the support member is adapted to permit expansion of the canted coil spring from the recess when the support member uncovers the open end of the recess.

5. The actuator assembly as claimed in claim 1, wherein the support member, the fixed member and the actuating member are concentric.

6. The actuator assembly as claimed in claim 1, wherein at least one of the canted coil springs is movable in a respective one of the plurality of recesses between first and second canted configurations within the recess, with a major axis of the canted coil spring being canted across a radius of the axis of the fixed member in each of the first and second canted configurations, wherein the canted coil spring is retained in one of the first and second configurations when the open end of the recess is covered, and wherein in the first canted configuration, the major axis of the canted coil spring is generally aligned with or parallel to a first diagonal of the recess, and wherein in the second canted configuration, the major axis of the canted coil spring is generally aligned with or parallel to a second diagonal of the recess.

7. The actuator assembly as claimed in claim 6, wherein in the first canted configuration of the canted coil spring, an outer end of the canted coil spring at the open end of the recess is axially closer to the shoulder than an inner end of the canted coil spring at an inner end of the recess.

8. The actuator assembly as claimed in claim 6, wherein engagement of the canted coil spring in the first canted configuration with the shoulder resists compression of the canted coil spring in the recess and resists axial movement of the shoulder past the open end of the recess.

9. The actuator assembly as claimed in claim 6, wherein in the first canted configuration, the major axis of the canted coil spring faces axially towards the shoulder.

10. The actuator assembly as claimed in claim 6, wherein in the second canted configuration of the canted coil spring, the canted coil spring permits compression of the canted coil spring into the recess, and wherein engagement of the canted coil spring in the second canted configuration with the shoulder permits axial movement of the shoulder past the canted coil spring.

11. The actuator assembly as claimed in claim 6, wherein the canted coil spring adopts a neutral configuration in transition between the first and second canted configurations, and wherein in the neutral configuration of the canted coil spring, the canted coil spring can be shifted in the recess between the first and second canted configurations by axial movement of the actuating member or the support member relative to the canted coil spring.

12. The actuating assembly as claimed in claim 1, wherein when the shoulder engages the part of the at least one canted coil spring extending from the open end of the respective recess, a leading end of the actuating member covers the open end of the recess.

13. The actuator assembly as claimed in claim 1, wherein the support member comprises a sleeve, having a bore with an axis.

14. The actuator assembly as claimed in claim 1, wherein the actuating member comprises a piston sealed within a bore, and wherein the actuating member is sealed within the bore by more than one seal, dividing portions of the bore into different zones between the seals.

15. The actuator assembly as claimed in claim 1, wherein the actuating member is biased axially in a first direction by a resilient biasing device.

16. The actuator assembly as claimed in claim 15, wherein axial movement of the actuating member is controlled by controlling a fluid pressure differential opposing a force of the resilient biasing device.

17. The actuator assembly as claimed in claim 1, wherein the support member can move axially relative to at least one of the canted coil springs in response to the axial movement of the actuating member.

18. The actuator assembly as claimed in claim 1, wherein the shoulder has first and second faces facing in opposite directions, wherein the first face of the shoulder is adapted to engage with at least one of the canted coil springs in a first configuration to arrest movement of the actuating member in a first direction, and wherein the second face of the shoulder is adapted to engage with at least one of the canted coil springs in a second configuration to arrest movement of the actuating member in a second direction.

19. A valve for an oil, gas or water well, having an actuator assembly, the actuator assembly comprising:

a fixed member having an axis;

an actuating member being moveable axially with respect to the fixed member;

first and second open-ended recesses on one of the fixed member and the actuating member, wherein the first recess at least partially houses a first canted coil spring and the second recess at least partially houses a second canted coil spring;

a radially extending shoulder on the other of the actuating member and the fixed member adapted to engage at least a part of the first canted coil spring extending from an open end of the first recess; and a support member adapted to cover open ends of the first and second recesses and being moveable axially into different axial positions with respect to the first and second recesses to uncover open ends of different ones of the first and second recesses in the different axial positions of the support member;

wherein the actuating member is movable relative to the support member, and wherein the support member is adapted to remain in position relative to the first canted coil spring when the actuating member moves away from the support member.

20. A method of actuating a tool for an oil, gas or water well, the tool having an actuator assembly comprising:

a fixed member having an axis;

an actuating member moveable axially with respect to the fixed member;

first and second open-ended recesses on one of the fixed member and the actuating member, wherein the first recess at least partially houses a first canted coil spring and the second recess at least partially houses a second canted coil spring;

a radially extending shoulder on the other of the actuating member and the fixed member adapted to engage the first canted coil spring within the first recess; and a support member adapted to cover open ends of the first and second recesses and being moveable axially into different axial positions with respect to the first and second recesses;

wherein the method includes:

moving the actuating member axially with respect to the fixed member;

moving the support member past at least a part of the open end of the first recess housing the first canted coil spring; and restricting axial movement of the actuating member by engaging the shoulder with at least a part of the first canted coil spring extending from the open end of the first recess.

21. The method as claimed in claim 20 wherein the actuating member pushes the support member between the different axial positions.

22. The method as claimed in claim 20, wherein the actuating member moves the support member in only one direction relative to the first canted coil spring.

23. The method as claimed in claim 20, wherein when the actuating member moves axially away from the support member, the support member remains in position relative to the first canted coil spring and does not move with the actuating member.

24. The method as claimed in claim 20, wherein axial movement of the actuating member in a first direction moves the support member in the first direction, so that the support member moves with the actuating member in the first direction, and wherein upon subsequent axial movement of the actuating member in a second direction opposite to the first direction, the actuating member and support member separate, with the support member remaining static, and remaining in position, while the actuating member moves axially away from the support member in the second direction.

25. The method as claimed in claim 20, including changing the configuration of the first and second canted coil springs in the first and second recesses by moving the actuating member across uncovered open ends of the first and second recesses.

26. The method as claimed in claim 20, including shifting the first and second canted coil springs between different canted positions by moving the actuating member across the open ends of the first and second recesses first in one direction and then in an opposite direction.

* * * * *